US006292641B1

(12) United States Patent
Takeyama et al.

(10) Patent No.: US 6,292,641 B1
(45) Date of Patent: Sep. 18, 2001

(54) IMAGE FORMING APPARATUS SELECTIVELY OPERATING ONE OF A PLURALITY OF DEVELOPING UNITS AND A METHOD FOR CONTROLLING A SWITCHING OPERATION FOR THE DEVELOPING UNITS

(75) Inventors: Yoshinobu Takeyama, Kanagawa; Masanori Saitoh, Tokyo; Hideaki Kibune; Nobuyuki Yanagawa, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/122,114

(22) Filed: Jul. 24, 1998

(30) Foreign Application Priority Data

| | | |
|---|---|---|
| Jul. 28, 1997 | (JP) | 9-201599 |
| Oct. 2, 1997 | (JP) | 9-270136 |
| Oct. 24, 1997 | (JP) | 9-292020 |

(51) Int. Cl.[7] ..... G03G 15/08; G03G 21/00
(52) U.S. Cl. ..... 399/228; 399/302; 399/223
(58) Field of Search ..... 399/228, 308, 399/302, 223

(56) References Cited

U.S. PATENT DOCUMENTS

| | | | |
|---|---|---|---|
| 4,615,607 | | 10/1986 | Yanagawa et al. . |
| 5,103,764 | * | 4/1992 | Fujiwara et al. . |
| 5,148,220 | * | 9/1992 | Hilbert et al. . |
| 5,276,479 | | 1/1994 | Inomata . |
| 5,321,475 | | 6/1994 | Horiuchi et al. . |
| 5,386,286 | * | 1/1995 | Kinouchi et al. . |
| 5,495,327 | * | 2/1996 | Inomata . |
| 5,585,898 | | 12/1996 | Fujii . |
| 5,749,031 | * | 5/1998 | Miwa et al. ..... 399/228 |
| 5,828,934 | * | 10/1998 | Tamura et al. ..... 399/228 |
| 5,915,074 | | 6/1999 | Shimazawa et al. . |

FOREIGN PATENT DOCUMENTS

| | | |
|---|---|---|
| 0 837 373 | 4/1998 | (EP) . |
| 64-971 | 1/1964 | (JP) . |
| 61-74566 | 8/1986 | (JP) . |
| 63-21670 | 1/1988 | (JP) . |
| 63-225254 | 9/1988 | (JP) . |
| 4-204871 | 7/1992 | (JP) . |
| 4-221974 | 8/1992 | (JP) . |
| 4-280273 | 10/1992 | (JP) . |
| 5-216337 | 8/1993 | (JP) . |
| 5-249833 | 9/1993 | (JP) . |
| 5-333701 | 12/1993 | (JP) . |
| 7-13434 | 1/1995 | (JP) . |
| 8-179621 | 7/1996 | (JP) . |
| 10-31342 | 2/1998 | (JP) . |
| 10031342 | 3/1998 | (JP) . |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An image forming apparatus is provided which can selectively drive a plurality of developing units by a simple structure accommodated in a small space. Two image stations are arranged along a direction of movement of an intermediate transfer belt. Each of the image stations is provided with a plurality of developing units arranged around a photosensitive drum. A developing unit driving system drives the plurality of developing units. A switching mechanism switches a transmission path of a power generated by the developing unit driving system so that the power is selectively transmitted to one of the developing units.

18 Claims, 24 Drawing Sheets

IMAGE FORMING APPARATUS SELECTIVELY OPERATING ONE OF A PLURALITY OF DEVELOPING UNITS AND A METHOD FOR CONTROLLING A SWITCHING OPERATION FOR THE DEVELOPING UNITS

BACKGROUND OF THE INVENTION

1. Field of the Invention

The present invention generally relates to an image forming apparatus and, more particularly, to an image forming apparatus having a plurality of developing units selectively operated to develop, for example, different color component images.

2. Description of the Related Art

Japanese Laid-Open Patent Application No. 64-971 discloses a technique for selectively driving a plurality of developing units by using a single drive power source. A power generated by the drive power source is transmitted to each of the developing units via a train of gears and a clutch provided to each of the developing units. Accordingly, one of the developing units can be selectively operated by operating the clutch.

According to this technique, since a power of the drive power source is transmitted to each clutch, a complex train of gears is needed and a space for accommodating the gears is needed. Accordingly, this technique is not appropriate for reducing size of an image forming apparatus using this technique.

Japanese Laid-Open Patent Application No. 4-280273 discloses a mechanism for selectively operating one of a plurality of developing units. This mechanism includes a drive gear which is driven by a single drive power source and four shift gears connected to respective developing units. Each of the shift gears is disengageably engaged with the drive gear by means of a pressing cam so that the shift gears are selectively engaged with the drive gear.

According to the above-mentioned mechanism, since the four shift gears are selectively engaged with the drive gear, a complex mechanism is needed for operating the pressing cam.

Additionally, Japanese Laid-Open Patent Applications No. 5-249833, No. 5-216337. No. 8-179621 and No. 5-333701 disclose developing apparatuses having a plurality of developing rollers such as a first developing roller for developing a latent image on a photosensitive drum by a first component color and a second developing roller for developing a latent image by a second component color. In these apparatuses, when a developing operation is switched from one of the developing rollers to another one of the developing rollers, a bristle cutting operation is performed by reversing the developing roller after the developing operation by the one of the developing units is completed.

However, the above-mentioned patent documents do not refer to a mechanism for driving each of the developing rollers. If each of the developing rollers has an individual drive power source, the size of the developing apparatuses is increased which results in an increase in the size of an image forming apparatus using such a developing apparatus. Accordingly, it has been suggested to use a common drive power source for the developing rollers.

When such a mechanism in which a power is selectively transmitted from a single common drive power source to a plurality of developing rollers is used, an engagement of a power transmitting gear is switched from one of the developing rollers to another one of the developing rollers. When a gear is engaged with another gear, the engagement can be smoothly performed when a top of a tooth of one of the gears faces a bottom of a tooth of the other one of the gears. On the other hand, if a top of a tooth of one of the gears faces a top of a tooth of the other one of the gears, it may be difficult to make a smooth engagement since the tops of the teeth run against each other. Accordingly, if such a condition occurs in the above-mentioned developing apparatus, a smooth switching operation of the driving mechanism of the developing rollers cannot be performed.

SUMMARY OF THE INVENTION

It is a general object of the present invention to provide an improved and useful image forming apparatus in which the above-mentioned problems are eliminated.

A more specific object of the present invention is to provide an image forming apparatus which can selectively drive a plurality of developing units by a simple structure accommodated in a small space.

Another object of the present invention is to provide an image forming apparatus in which a switching operation of a driving mechanism of developing rollers can be smoothly performed.

A further object of the present invention is to provide an image forming apparatus which can provide an increased time for switching operations of developing rollers without increasing a total image processing time.

In order to achieve the above-mentioned objects, there is provided according to one aspect of the present invention an image forming apparatus provided with an intermediate transfer member and a plurality of image stations arranged along a direction of movement of the intermediate transfer member, each of the image stations comprising an image carrying member and a plurality of developing units so that latent images sequentially formed on the image carrying member are developed by one of the developing units and developed images are transferred onto the intermediate transfer member so as to be superimposed thereon, each of the image stations of the image forming apparatus comprising:

a developing unit driving system driving the plurality of developing units; and a switching mechanism switching a transmission path of a power generated by the developing unit driving system so that the power is selectively transmitted to one of the plurality of developing units.

According to the above-mentioned invention, a plurality of developing units can be driven by the single common driving system with a simple structure occupying a small space.

In one embodiment of the present invention, a plurality of developing units are provided in each of the image stations, and the switching mechanism of each of the image stations includes:

a rotational member supporting a plurality of driving-side power transmission mechanisms each of which is a final stage of the developing unit driving system; and a rotational driving mechanism rotating the rotational member, and each of the plurality of developing units is connected to a driven-side power transmission mechanism selectively connectable to one of the driving-side power transmission mechanisms in accordance with a rotational position of the rotational member.

Accordingly, a rapid switching of the power transmission path can be reliably performed.

Additionally, the developing unit driving system, the rotational member and the rotational driving mechanism constituting the switching mechanism may be incorporated into a single unit so that an efficient assembly operation can be achieve.

Additionally, the developing unit driving system may include a power transmission shaft used as a center of rotation of the rotational member so as to simplify a structure of the developing unit driving system.

In one embodiment of present invention, the rotational driving mechanism may include a worm gear and a motor for driving the worm gear, the worm gear being engaged with a sector gear provided to the rotational member so as to rotate the rotational member. The motor may be a reversible motor.

Alternatively, the rotational driving mechanism may include a cam engaged with a cam follower provided to the rotational member so that a reverse operation of the rotational driving mechanism is not needed. The cam may include an annular groove, and the cam follower may movably fit in the annular groove so that there is no need to apply a force to the cam follower.

Further, the rotational driving mechanism may include a solenoid actuator for swinging the rotational member so that the rotational driving mechanism has a simple structure.

In one embodiment of the present invention, the developing unit driving system may comprise a motor and a train of gears connected to the motor.

Additionally, each of the driving-side power transmission mechanisms may comprise a gear, and each of the driven-side power transmission mechanisms may comprise a gear.

Additionally, there is provided according to another aspect of the present invention a developing apparatus for developing a latent image formed on an image carrying member by a first developing roller and a second developing roller, the first developing roller developing a latent image in a first color and the second developing roller developing a latent image in a second color, a bristle cutting operation being performed by reversely rotating one of the first developing roller and the second developing roller when the one of the first developing roller and the second developing roller which has performed a developing operation is switched to the other, the developing apparatus comprising:

a first gear arrangement connected to the first developing roller;

a second gear arrangement connected to the second developing roller;

a drive gear mechanism engageable with the first gear arrangement and the second gear arrangement for transmitting a drive power so as to commonly drive the first developing roller and the second developing roller;

a rotational member moving the drive gear mechanism so that the second gear arrangement is disengaged from the drive gear mechanism when the first gear arrangement is engaged with the drive gear mechanism and the first gear arrangement is disengaged from the drive gear mechanism when the second gear arrangement is engaged with the drive gear mechanism; and control means for controlling timing of a switching operation for switching an engagement of the drive gear mechanism from one of the first gear arrangement and the second gear arrangement to the other so that the switching operation is performed during a reverse operation of the drive gear mechanism.

According to the above-mentioned invention, since the switching operation is performed during a reverse operation of the drive gear mechanism, the drive gear mechanism can be easily engaged with the first or second gear arrangement.

Additionally, there is provided according to another aspect of the present invention a method for controlling a developing apparatus for developing a latent image formed on an image carrying member by a first developing roller and a second developing roller, the first developing roller developing a latent image in a first color and the second developing roller developing a latent image in a second color, a bristle cutting operation being performed by reversely rotating one of the first developing roller and the second developing roller when the one of the first developing roller and the second developing roller which has performed a developing operation is switched to the other, the developing apparatus comprising:

a first gear arrangement connected to the first developing roller;

a second gear arrangement connected to the second developing roller;

a drive gear mechanism engageable with the first gear arrangement and the second gear arrangement for transmitting a drive power so as to commonly drive the first developing roller and the second developing roller; and a rotational member moving the drive gear mechanism so that the second gear arrangement is disengaged from the drive gear mechanism when the first gear arrangement is engaged with the drive gear mechanism and the first gear arrangement is disengaged from the drive gear mechanism when the second gear arrangement is engaged with the drive gear mechanism, the method for controlling the developing apparatus comprising the steps of:

reversely operating the drive gear mechanism so as to perform the bristle cutting operation; and switching an engagement of the drive gear mechanism from one of the first gear arrangement and the second gear arrangement to the other while the drive gear mechanism is reversely operated.

According to the above-mentioned invention, since the switching operation is performed during a reverse operation of the drive gear mechanism, the drive gear mechanism can be easily engaged with the first or second gear arrangement.

Additionally, there is provided according to another aspect of the present invention a method for controlling a plurality of developing apparatuses arranged along an intermediate transfer member, each of the developing apparatuses developing a latent image formed on an image carrying member by a first developing roller and a second developing roller, the first developing roller developing a latent image in a first color and the second developing roller developing a latent image in a second color, a bristle cutting operation being performed by reversely rotating one of the first developing roller and the second developing roller when the one of the first developing roller and the second developing roller which has performed a developing operation is switched to the other, each of the developing apparatuses comprising:

a first gear arrangement connected to the first developing roller;

a second gear arrangement connected to the second developing roller;

a drive gear mechanism engageable with the first gear arrangement and the second gear arrangement for transmitting a drive power so as to commonly drive the first developing roller and the second developing roller; and a rotational member moving the drive gear mechanism so that the second gear arrangement is disengaged from the drive gear mechanism when the first gear arrangement is engaged with the drive gear mechanism and the first gear arrangement is disengaged from the drive gear mechanism when the second gear arrangement is engaged with the drive gear mechanism, the method for controlling the developing apparatuses comprising the steps of:

operating the first and second developing rollers of each of the developing apparatuses in a predetermined order of use so as to sequentially develop the latent images;

transferring developed images from the image carrying member of each of the developing apparatuses to the intermediate transfer member so as to be superimposed thereon; and controlling a switching operation for switching an engagement of the drive gear mechanism from one of the first gear arrangement and the second gear arrangement to the other in each of the developing apparatuses so that the switching operation is performed at a predetermined timing, the switching operation being performed during a reverse operation of the drive gear mechanism for performing the bristle cutting operation.

According to the above-mentioned invention, the latent images are sequentially developed and transferred onto the intermediate transfer member in a predetermined order of use of the developing rollers. This eliminates a switching operation of the developing rollers since the developing roller can be returned to a state in which a new image forming process cycle can be started. Thus, a complex control of output of image data stored in an image memory can be eliminated.

In the above-mentioned method, the predetermined timing may be defined as a time prior to a start of a development by the other of the first and second developing rollers.

In one embodiment of the present invention, the plurality of developing apparatuses may include a first developing apparatus and a second developing apparatus located on a downstream side of the first developing apparatus in a direction of movement of the intermediate transfer member, and an image on the intermediate transfer member is transferred onto a transfer paper at a position located on a downstream side of the second developing apparatus in the direction of movement of the intermediate transfer member, and the predetermined order is determined so that one of the first and second developing rollers in the first developing apparatus is operated first; one of the first and second developing rollers in the second developing apparatus is operated second; and the other of the first and second developing rollers in the first developing apparatus is operated third; the other of the first and second developing rollers in the second developing apparatus is operated fourth.

Accordingly, the developed image on each of the image carrying members can be efficiently transferred to the intermediate transfer member in a superimposed relationship and can be finally transferred onto the transfer paper.

Additionally, the plurality of developing apparatuses may include a first developing apparatus and a second developing apparatus located on a downstream side of the first developing apparatus in a direction of movement of the intermediate transfer member, and the predetermined order is determined so that one of the first and second developing rollers used at the end of an immediately preceding image forming cycle is used at the beginning of a subsequent image forming cycle.

Accordingly, when a plurality of sheets are continuously printed, a switching operation of the developing rollers is not necessary between one sheet and a subsequent sheet. This results in an increase in a processing speed of the image forming operation since a frequency of switching the developing rollers is reduced. Additionally, service life of the gears used in the switching mechanism can be extended.

In one embodiment of the present invention, one of the first developing roller and the second developing roller of one of the developing apparatuses which is set to be the first position in the predetermined order of use may be provided with a developer of a color which is most frequently used.

Accordingly, when a single color mode using the most frequently used color is selected, an image forming operation can be immediately started without switching the development roller to be used first. Additionally, a frequency of switching the developing rollers can be reduced.

Additionally, one of the first developing roller and the second developing roller of one of the developing apparatuses which is set to be the first position in the predetermined order of use is provided with a black developer.

Accordingly, when a single color mode using black is selected, an image forming operation can be immediately started without switching the development roller to be used first. Thus, a frequency of switching the developing rollers can be reduced.

Additionally, there is provided according to another aspect of the present invention a method for forming an image by using a developing apparatus for developing a latent image formed on an image carrying member by a first developing roller and a second developing roller, the first developing roller developing a latent image in a first color and the second developing roller developing a latent image in a second color, the first developing roller and the second developing roller being arranged along a circumference of the image carrying member so that the latent image formed on the image carrying member is developed by selectively switching to one of the first developing roller and the second developing roller, the method comprising the steps of:

firstly operating one of the first and second developing rollers which is located on an upstream side of the other in a direction of rotation of the image carrying member; and operating the other of the first and second developing rollers by switching the one of the first and second developing rollers to the other.

According to the above-mentioned invention, since an extra time can be provided to the period for performing the switching operation, a processing speed of the image forming operation can be increased when a superimposed color image including more than two color component images is formed.

Additionally, there is provided according another aspect of the present invention an image forming apparatus comprising a developing apparatus for developing a latent image formed on an image carrying member by a first developing roller and a second developing roller, the first developing roller developing a latent image in a first color and the second developing roller developing a latent image in a second color, the first developing roller and the second developing roller being arranged along a circumference of the image carrying member so that the latent image formed on the image carrying member is developed by selectively switching to one of the first developing roller and the second developing roller, wherein:

one of the first and second developing rollers which is located on an upstream side of the other in a direction of rotation of the image carrying member is operated first;

the other of the first and second developing rollers is operated by switching the one of the first and second developing rollers to the other; and the one of the first and second developing rollers located on the upstream side is provided with a black developer.

According to this invention, when a monochrome image is transferred onto the transfer paper via the intermediate transfer member, a processing speed of the image forming operation can be increased.

Additionally, there is provided according to another aspect of the present invention a method for forming an image by using a plurality of developing apparatuses each of which develops a latent image formed on an image carrying member by a first developing roller and a second developing roller, the first developing roller developing a latent image in a first color and the second developing roller developing a latent image in a second color, the first developing roller and the second developing roller being arranged along a circumference of the image carrying member so that the latent image formed on the image carrying member is developed by selectively switching to one of the first developing roller and the second developing roller, the developed images being sequentially transferred onto an intermediate transfer member and finally transferred onto a transfer paper, the method comprising the steps of:

firstly operating one of the first and second developing rollers which is located on an upstream side of the other in a direction of rotation of the image carrying member in each of the plurality of developing apparatuses; and operating the other of the first and second developing rollers by switching the one of the first and second developing rollers to the other in each of the plurality of developing apparatuses.

According to the above-mentioned invention, since an extra time can be provided to the period for performing the switching operation, a processing speed of the image forming operation can be increased when a superimposed color image including more than two color component images is formed.

Additionally, there is provided according to another aspect of the present invention an image forming apparatus for forming an image by using a plurality of developing apparatuses each of which develops a latent image formed on an image carrying member by a first developing roller and a second developing roller, the first developing roller developing a latent image in a first color and the second developing roller developing a latent image in a second color, the first developing roller and the second developing roller being arranged along a circumference of the image carrying member so that the latent image formed on the image carrying member is developed by selectively switching to one of the first developing roller and the second developing roller, the developed images being sequentially transferred onto an intermediate transfer member and finally transferred onto a transfer paper by a transfer roller, wherein:

one of the first and second developing rollers which is located on an upstream side of the other in a direction of rotation of the image carrying member in each of the plurality of developing apparatuses is operated first;

the other of the first and second developing rollers is operated by switching the one of the first and second developing rollers to the other in each of the plurality of developing apparatuses; and the one of the first and second developing rollers which is located on the upstream side in one of the plurality of developing apparatuses which is closest to the transfer roller is provided with a black developer.

According to this invention, when a monochrome image is transferred onto the transfer paper via the intermediate transfer member, a processing speed of the image forming operation can be increased.

Other objects, features and advantages of the present invention will become more apparent from the following descriptions when read in conjunction with the accompanying drawings.

DETAILED DESCRIPTION OF THE PREFERRED EMBODIMENTS

A description will now be given of a structure of an image forming apparatus and an image forming process to which the present invention is applied.

Figure 1:
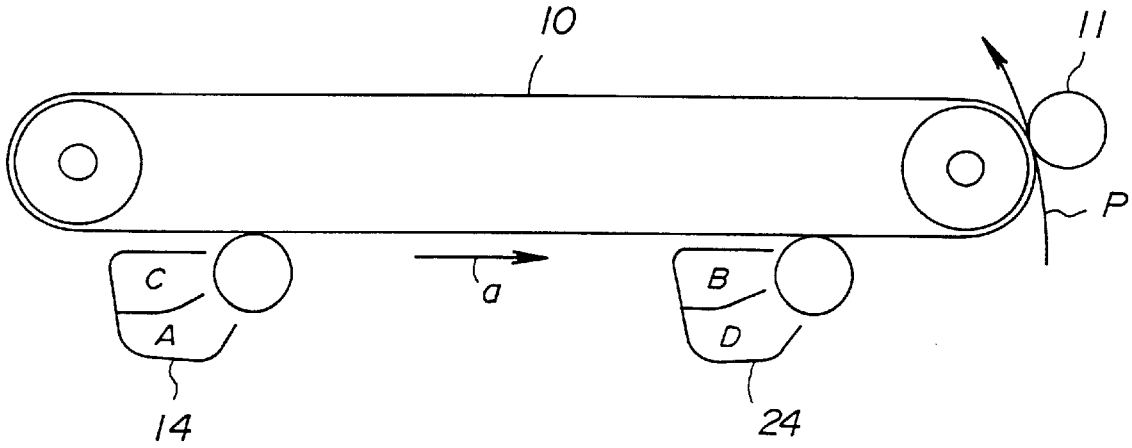
FIG. 1 is an illustration for explaining an example of an image forming method using an intermediate transfer belt.

There is an image forming method using an intermediate transfer belt. According to such an image forming method, a toner image including at least three primary colors, that is, colors A, B and C, is formed on an image carrier such as a photosensitive drum or a photosensitive belt. The toner image is transferred onto the intermediate transfer belt, and the color toner image on the intermediate transfer belt is transferred to a transfer paper by a transferring means. FIG. 1 is an illustration for explaining an example of such an image forming method using an intermediate transfer belt 10. In FIG. 1, a first image station 14 and a second image station 24 are arrange along the same side of the intermediate transfer belt 10 at a predetermined interval. The intermediate transfer belt 10 moves in a direction indicated by an arrow a. Each of the image stations 14 and 24 includes a photosensitive drum, a charging means and a developing means. A toner image formed by each of the image stations 14 and 24 is transferred onto the intermediate transfer belt 10 in a sequence shown in FIG. 2 or FIG. 3. A color toner image formed on the intermediate transfer belt 10 is finally transferred to a transfer paper P by a transfer means 11.

Figure 2:
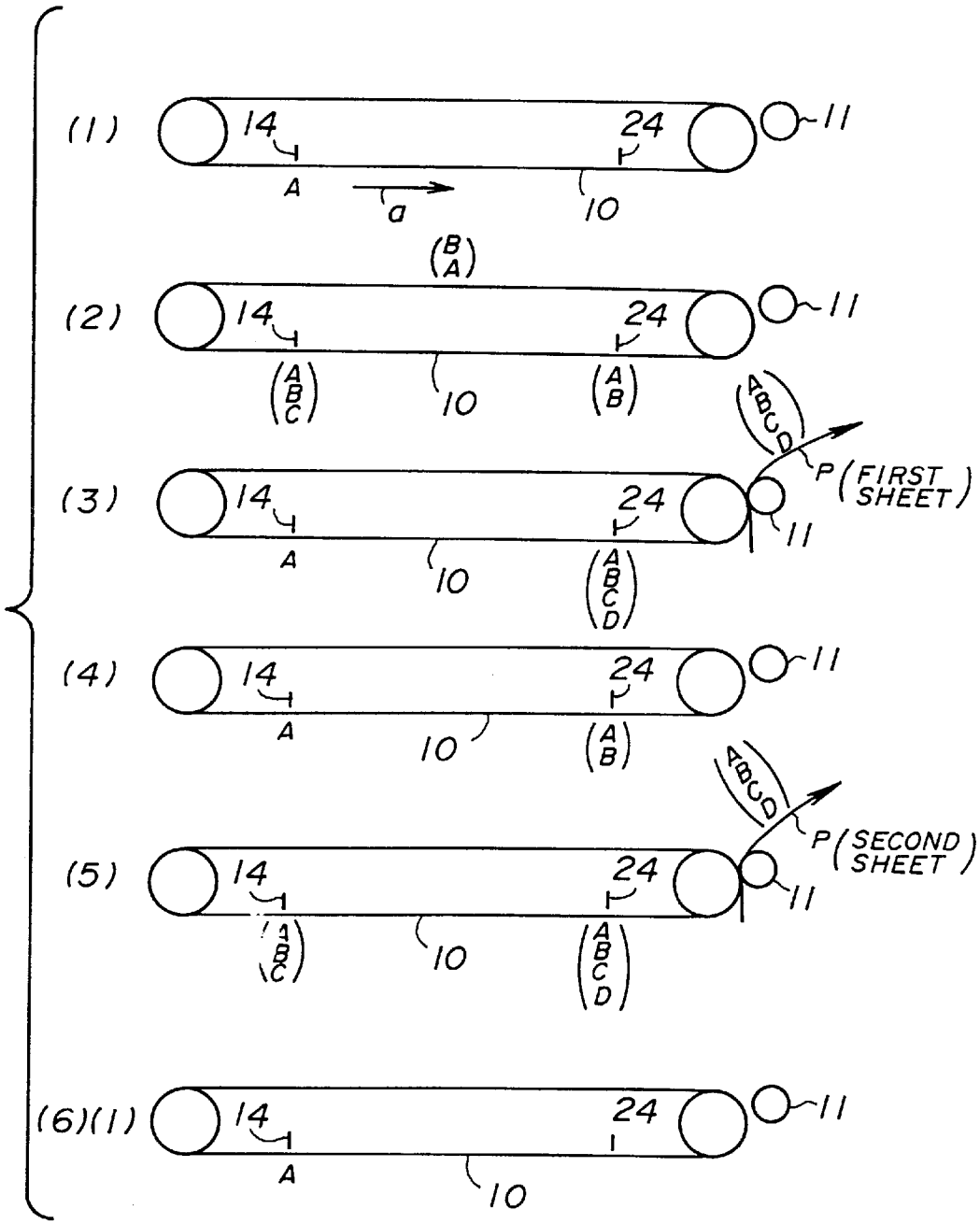
FIG. 2 is an illustration for explaining an image forming process performed by an image forming apparatus according to the present invention.
Figure 3:
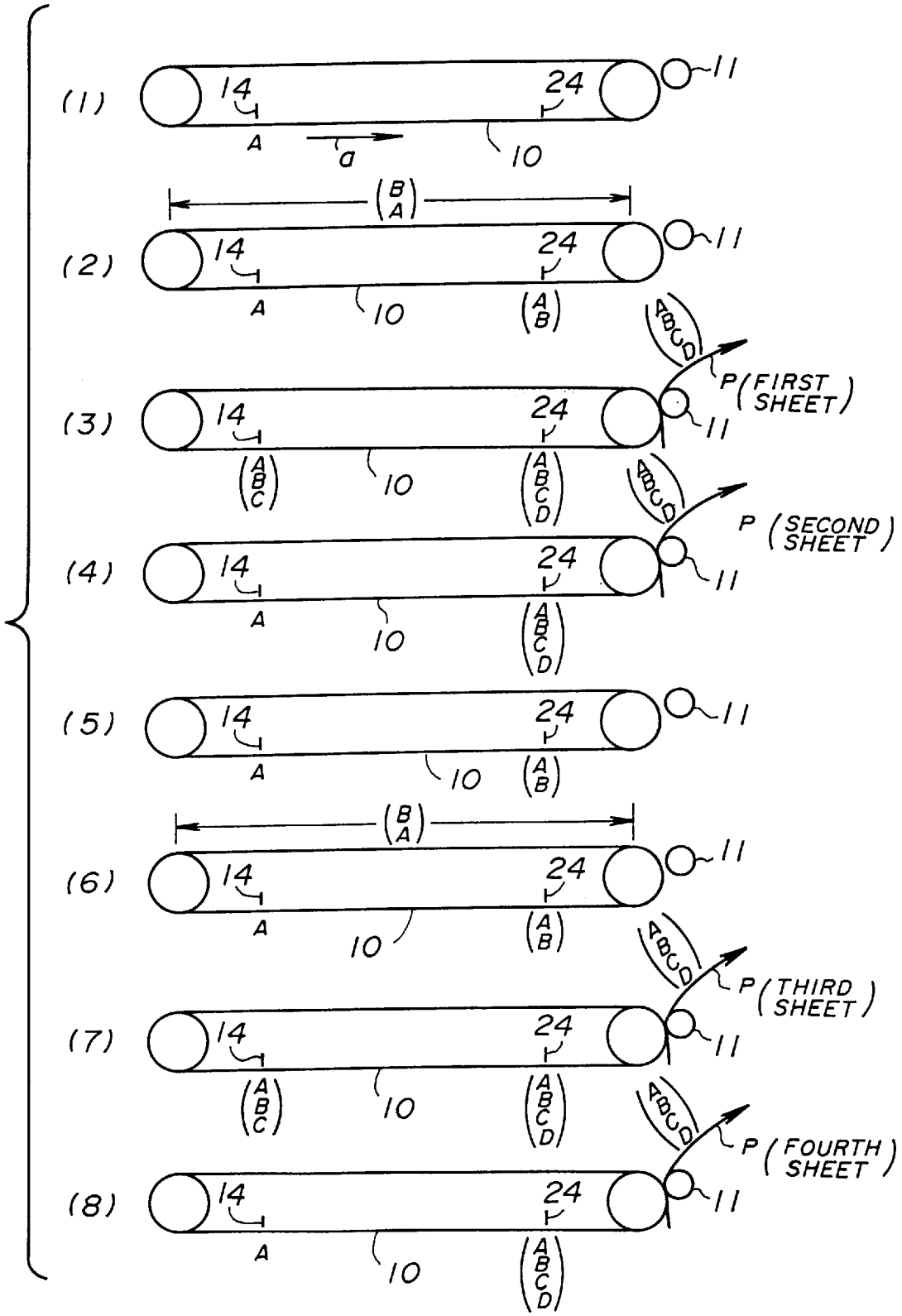
FIG. 3 is an illustration for explaining another image forming process performed by the image forming apparatus according to the present invention.

On the assumption that the entire length of the intermediate transfer belt 10 is L, and a length of the transfer paper P in a direction of movement when a transfer is performed is m, FIG. 2 shows a color image forming process of a case in which $L=m+\alpha$, and FIG. 3 shows a color image forming process of a case in which $L=2(m+\alpha)$. It should be noted that, in FIGS. 2 and 3, a represents a length of a non-image area of the intermediate transfer belt 10 measured in a direction of movement of the intermediate transfer belt 10. It is assumed that $\alpha<m$. It should be noted that the value of $\alpha$ varies in response to a length of an image area on the intermediate transfer belt and a length of the transfer paper P to be used. Accordingly, a condition $\alpha>m$ may happen depending on the length of the transfer paper P.

The image forming process shown in FIG. 2 is performed as follows.

(1) An A color toner image is transferred onto the intermediate transfer belt 10 by the first image station 14 having the A color developing means.

(2) A B-color toner image is transferred onto the A color toner image so as to be superimposed thereon by the second image station 24 so as to obtain A, B color toner image. A C color toner image is transferred onto the A, B color image so as to be superimposed thereon by the first image station 14 so as to obtain an A, B, C color toner image. At this time, the intermediate transfer belt 10 has rotated one complete turn.

(3) A D color toner image (black toner image) is transferred onto the A, B, C color toner image so as to obtain a full color image. The thus-obtained full color image is transferred onto the transfer paper P (first sheet) by the transferring means 11. The transfer to the transfer paper P is performed during a second rotation of the intermediate transfer belt 10.

(4) When a plurality of sheets are printed, the A color toner image is transferred onto the intermediate transfer belt 10 by the first image station 14 at the same time the D color toner image is transferred by the second image station 24 in the above step (3). Then, the B color toner image is transferred onto the A color toner image so as to be superimposed thereon by the second image station 24 so as to obtain the A, B color toner image.

(5) The C color toner image is transferred onto the A, B color image obtained in step (4) so as to be superimposed thereon by the first image station 14, and then the D color toner image is transferred by the second image station 24. The thus-obtained full color image is transferred to the transfer paper P (second sheet). The transfer to the transfer paper P (second sheet) is performed during a fourth rotation of the intermediate transfer belt 10.

(6) A third sheet can be obtained by repeating the process of step (3) and subsequent steps. That is, the third sheet can be printed during a sixth rotation of the intermediate transfer belt 10.

The image forming process shown in FIG. 3 is performed as follows.

(1) An A color toner image is transferred onto the intermediate transfer belt 10 by the first image station 14 having the A color developing means.

(2) A B-color toner image is transferred onto the A color toner image so as to be superimposed thereon by the second image station 24 so as to obtain an A, B color toner image. At the same time, another A color toner image is transferred onto the intermediate transfer belt 10 by the first image station 14. At this time, the intermediate transfer belt 10 has rotated one complete turn.

(3) Then, a C color toner image is transferred onto the A, B color toner image obtained in step (2) so as to be superimposed thereon by the first image station 14 so as to obtain an A, B, C color toner image on the intermediate transfer belt 10. A D color toner image (black toner image) is transferred onto the A, B, C color toner image so as to obtain a full color image. The thus-obtained full color image is transferred onto the transfer paper P (first sheet) by the transferring means 11. The transfer to the transfer paper P is started after the intermediate transfer belt 10 has rotated about 1.5 turns.

(4) When a plurality of sheets are printed, the A, B, C color toner image is obtained by the first image station 14, and then the D color toner image is transferred onto the A, B, C color toner image by the second image station 24 while another A color toner image is transferred by the first image station 14. The thus-obtained full color image is transferred on to the transfer paper P (second sheet). The transfer to the transfer paper P (second sheet) is started after the intermediate transfer belt 10 has rotated about 2.5 turns.

(5) Then, the B color toner image is transferred onto the A color toner image so as to be superimposed thereon by the second image station 24 so as to obtain the A, B color toner image.

(6) A B-color toner image is transferred onto the A color toner image obtained in step (4) so as to be superimposed thereon by the second image station 24 so as to obtain an A, B color toner image. At the same time, another A color toner image is transferred onto the intermediate transfer belt 10 by the first image station 14.

(7) A C color toner image is transferred onto the A, B color toner image obtained in step (6) so as to be superimposed thereon by the first image station 14 so as to obtain an A, B, C color toner image, and then a D color toner image is transferred onto the thus-obtained A, B, C color toner image so as to be superimposed thereon by the second image station 24. The thus-obtained full color image is transferred to the transfer paper P (third sheet). The transfer to the transfer paper P (third sheet) is started after the intermediate transfer belt has rotated about 3.5 turns.

(8) Then, a D color toner image is transferred onto the A, B, C color toner image obtained in step (7) by the second image station 24 while an A color toner image is transferred onto the intermediate transfer belt 10 by the first image station 14. The thus-obtained full color image is transferred onto the transfer paper P (fourth sheet). The transfer to the transfer paper P (fourth sheet) is started after the intermediate transfer belt has rotated about 4.5 turns.

As mentioned above, when the intermediate transfer belt 10 has a length more than twice the length of the transfer paper P, the first sheet is printed during a second rotation of the intermediate transfer belt 10; the second sheet is printed during the third rotation; the third sheet is printed during the fourth rotation; and the fourth sheet is printed during the fifth rotation. That is, a printing operation for each sheet is started after the intermediate transfer belt 10 has rotated a number of turns obtained by adding 0.5 to the number of sheets to be printed. Each of the completely printed sheets is obtained after the intermediate transfer belt 10 has rotated a number of turns which is obtained by adding 1 to the respective number of completely printed sheets.

Figure 4:
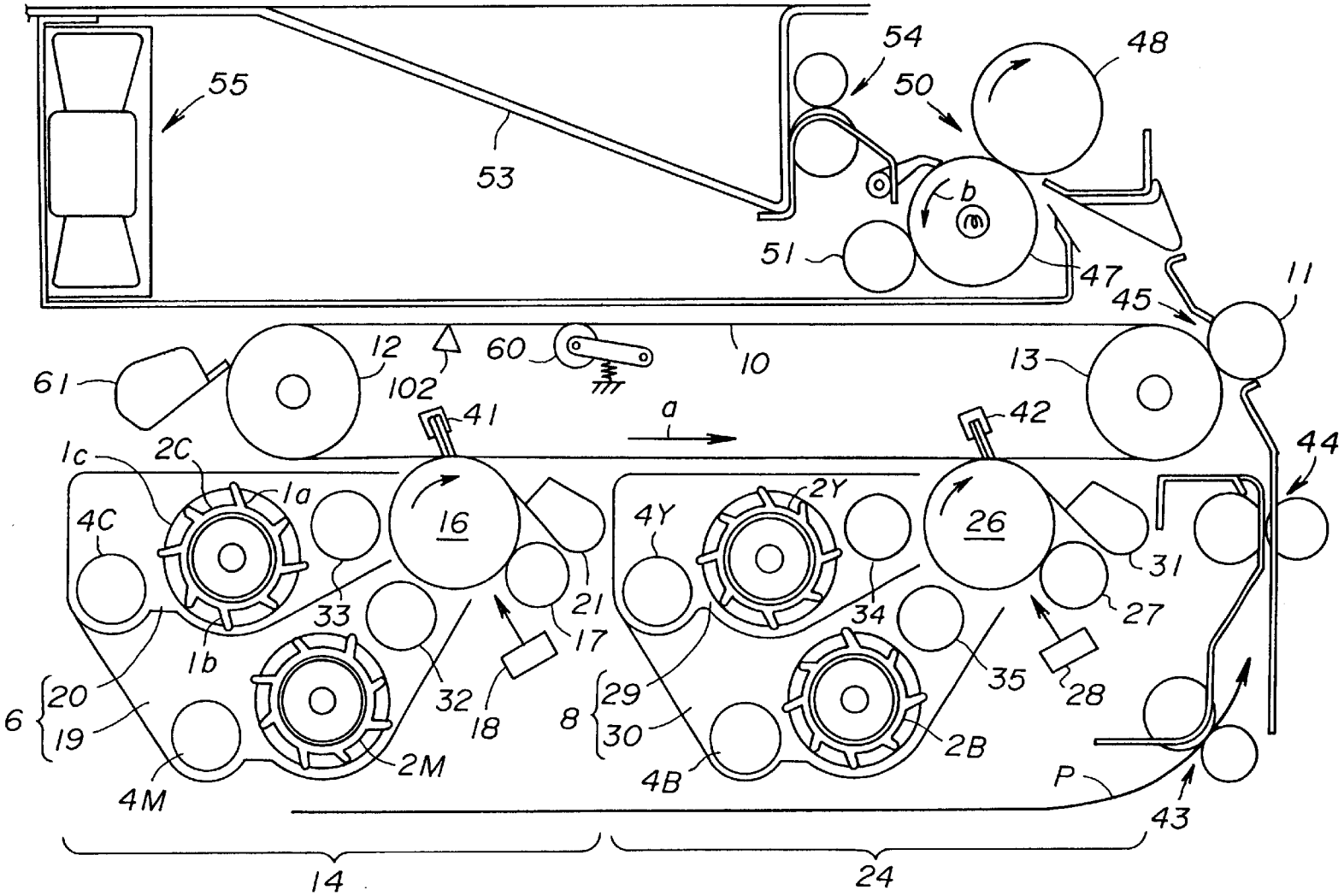
FIG. 4 is an illustration of an image forming apparatus to which the present invention is applied.

FIG. 4 shows an entire structure of the image forming apparatus to which the present invention is applied. The intermediate transfer belt 10 is engaged with an idle roller 12 and a drive roller 13, and is driven by the drive roller 13 in a direction indicated by an arrow a. The intermediate transfer belt 10 is provided with a tension by a tension roller 60. The first image station 14 and the second image station 24 are arranged on the lower side of the intermediate transfer belt 10 in the moving direction of the intermediate transfer belt 10 at a predetermined interval. The intermediate transfer belt 10 has a length longer than a length of the maximum size transfer paper by a length of a non-image area.

The first image station 14 comprises a photosensitive drum 16, a charger 17, a writing means 18, an A color developing unit 19, a C color developing unit 20 and a cleaning unit 21. The charger 17 comprises a roller for uniformly charging a surface of the photosensitive drum 16. The writing means 18 writes a latent image on the charged surface of the photosensitive drum 16 by a beam modulated by an image signal generated according to an original document. The A color developing unit 19 and the C color developing unit 20 together constitute a first developing device 6.

Similar to the first image station 14, the second image station 24 comprises a photosensitive drum 26, a charger 27, a writing means 28, a B color developing unit 29, a D color developing unit 30 and a cleaning unit 31. The charger 27 comprises a roller for uniformly charging a surface of the photosensitive drum 26. The writing means 28 writes a latent image on the charged surface of the photosensitive drum 26 by a beam modulated by an image signal generated according to an original document. The B color developing unit 29 and the D color developing unit 30 together constitute a second developing device 8. The second image station 24 is positioned in the same orientation as the first image station 14 with respect to the intermediate transfer belt 10.

Each of the image stations 14 and 24 is detachably attached to a body of the image forming apparatus. A rotation of each of the photosensitive drums 16 and 26 are synchronized with a movement of the intermediate transfer belt 10. A circumferential speed of each of the photosensitive drums 16 and 26 is controlled to be accurately equal to the moving speed of the intermediate transfer belt 10. A corona discharger or a brush-type charger may be used instead of the chargers 17 and 27.

Each of the developing units 19, 20, 29 and 30 uses a two-component developer. The A color developing unit 19 stores magenta toner and carrier. The C color developing unit 20 stores cyan toner and carrier. The B color developing unit 29 stores yellow toner and carrier. The D color developing unit 30 stores black toner and carrier. A latent image is formed on each of the photosensitive drums 16 and 26 by means of the respective chargers 17 and 27 and the writing means 18 and 28 by a known method. Each of the developing units 19, 20, 29 and 30 develops the latent image on the respective photosensitive drums 16 and 26 by respective developing rollers 32, 33, 34, 35. Each of the developing rollers 32, 33, 34 and 35 uses a magnetic brush developing method which uses a stationary magnet and a non-magnetic sleeve rotated around the magnet.

Figure 5:
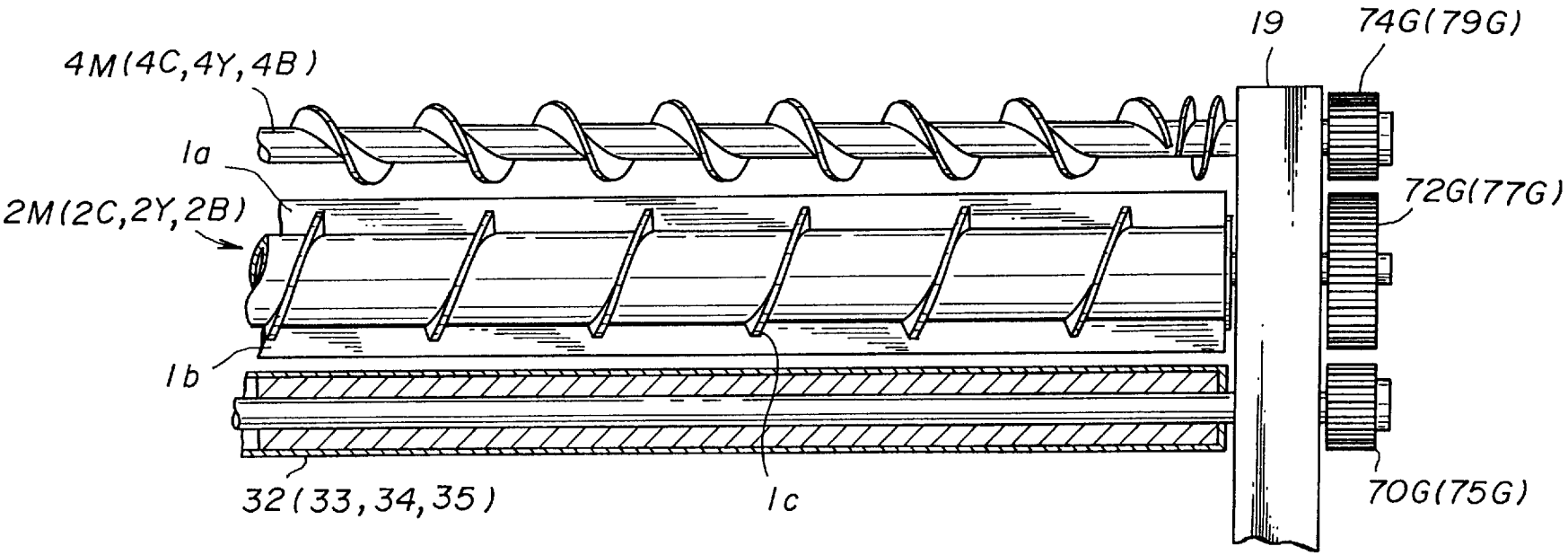
FIG. 5 is a side view of a part of a developing unit.

The four developing units 19, 20, 29 and 30 have the same construction as shown in FIG. 5, and comprise paddles 2M, 2C, 2Y, and 2B for stirring developer and conveying screws 4M, 4C, 4Y and 4B for supplying toner, respectively. A known color developing unit such as, for example, disclosed in Japanese Laid-Open Patent Application No.8-160697 may be used.

Each of the conveying screws 4M, 4C, 4Y and 4B has a configuration in which a blade is spirally wound on a shaft. Each of the paddles 2M, 2C, 2Y and 2B has a spiral blade and eight radially extending blades so as to provide both a stirring function and a conveying function. In FIG. 4, two opposite blades among eight blades are indicated by la and lb as an example. In FIG. 5, the spiral blade is indicated by lc and the two opposite blades la and lb are indicated, and other blades are omitted.

The paddle 2M and the conveying screw 4M are rotated so as to convey developer in opposite directions along the longitudinal direction of the developing roller 32 so that the developer is evenly distributed in the longitudinal direction of the developing roller 32. The photosensitive drums 16 and 26 are provided with the a first transfer brush 41 and a second transfer brush 42, respectively, with the intermediate transfer belt 10 therebetween. A bias voltage for transfer is provided to each of the first and second transfer brushes 41 and 42. The drive roller 13 is provided with a transfer roller 11 with the intermediate transfer belt therebetween. A bias voltage for transfer is provided to the transfer roller 11. It should be noted that a transfer roller may be used instead of each of the first and second transfer brushes 41 and 42.

Figure 6:
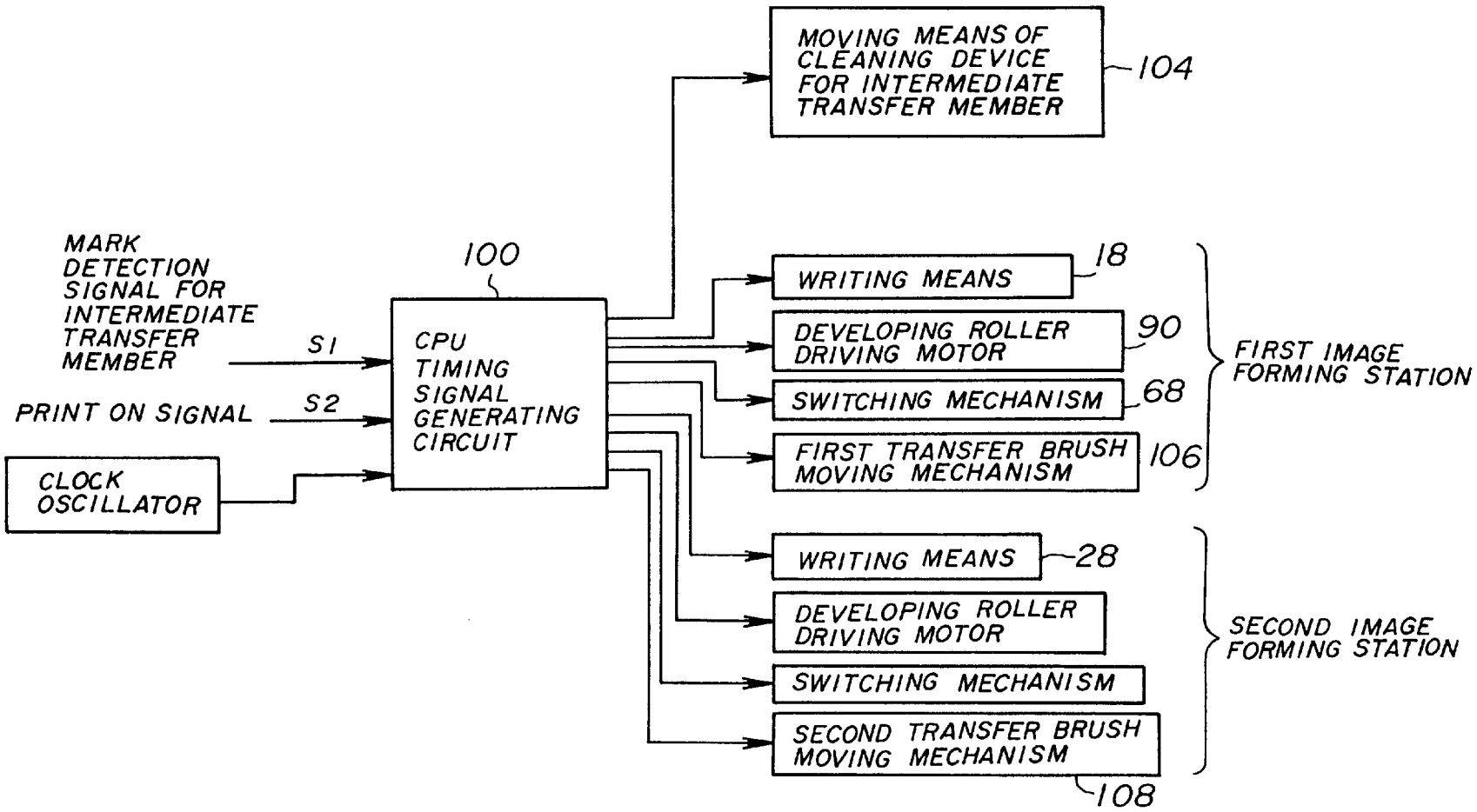
FIG. 6 is a block diagram of a control system of the image forming apparatus shown in FIG. 4.

Each of the photosensitive drums 16 and 26 is slightly apart away from the intermediate transfer belt 10 downwardly in a normal state. Additionally, each of the first and second transfer brushes 41 and 42 is slightly apart away from the intermediate transfer belt 10 upwardly. The first and second transfer brushes 41 and 42 are pressed against the intermediate transfer belt 10 in a process for transferring a toner image on the photosensitive drums 16 and 26 to the intermediate transfer belt 10 so that the intermediate transfer belt 10 is put in contact with the photosensitive drums 16 and 26. The first and second transfer brushes 41 and 42 are operated by a first transfer brush moving means 106 and a second transfer brush moving means 108 shown in FIG. 6. FIG. 6 is a block diagram of a control system of the image forming apparatus shown in FIG. 4.

The drive roller 13 and the transfer roller 11 together constitute a transfer unit 45 of a color image. A corona discharger may be used instead of the first and second transfer brushes 41 and 42. The idle roller 12 is provided with a cleaning device 61 which removes residual toner on the intermediate transfer belt 10. A movement of the cleaning device 61 is controlled by an intermediate transfer belt cleaning device moving means 104 shown in FIG. 6.

A paper feed device (not shown) is provided under the first and second image stations 14 and 24 for feeding transfer papers one by one in the rightward direction in FIG. 4. The transfer paper P fed from the paper feed device is supplied to the transfer unit 45 by a pair of feed rollers 43 and a pair of register rollers 44. A fixing device 50 is provided diagonally above the transfer unit 45. The fixing device 50 comprises a heat roller 47 and a pressing roller 48. The heat roller 47 is rotated in a direction indicated by an arrow b. The pressing roller 48 is rotated by being pressed against the heat roller 47. A roller 51 contacts the heat roller 47 so as to apply anti-offset liquid to a surface of the heat roller 47.

A pair of eject rollers 54 are provided on the downstream side of the fixing device 50. The eject rollers 54 convey the transfer paper ejected from the fixing device 50 to an eject tray 53. A ventilation fan 55 is provided on an upper left portion in FIG. 4 for releasing heat from inside the image forming apparatus so that electric parts provided under the eject tray 53 are prevented from being heated due to heat released by the fixing device 50.

Figure 7:
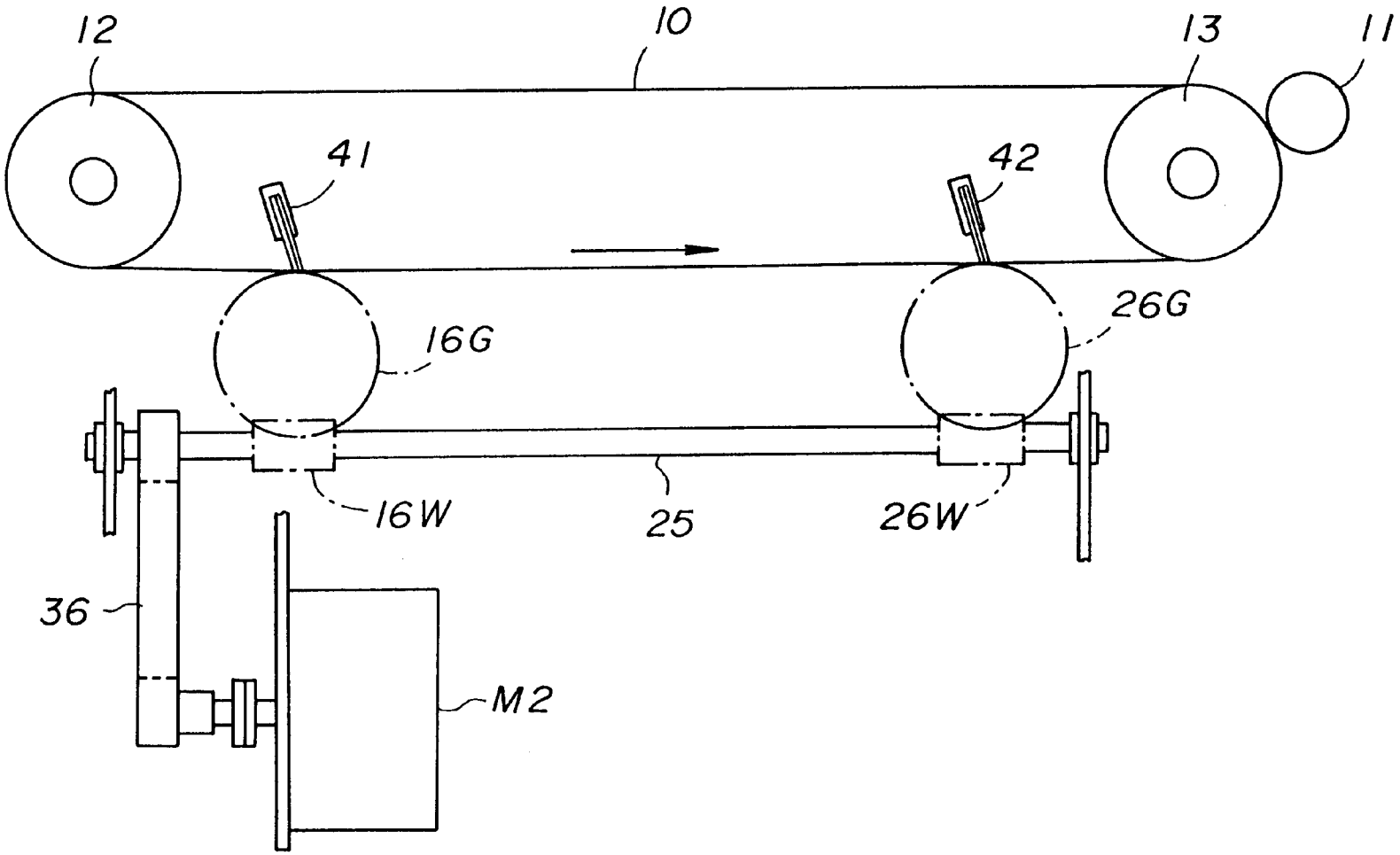
FIG. 7 is an illustration for explaining a driving mechanism of photosensitive drums.

The photosensitive drum 16 of the first image station 14 has the same configuration, size and material as the photosensitive drum 26 of the second image station 24. The photosensitive drums 16 and 26 must be rotated at the same speed. Accordingly, as shown in FIG. 7, the photosensitive drums are driven by the same motor M2. Specifically, the photosensitive drum 16 is provided with a gear 16G and a worm gear 16W which engages with the gear 16G, and the photosensitive drum 26 is provided with a gear 26G and a worm gear 26W which engages with the gear 26G. The gear 16G is identical to the gear 26G, and the worm gear 16W is identical to the worm gear 26W. The worm gears 16W and 26W are fixed to the same shaft 25 which is rotated by the motor M2 via a belt 36. Accordingly, the rotational speed of the photosensitive drum 16 is completely the same as the rotational speed of the photosensitive drum 26, and the circumferential speed of the photosensitive drums 16 and 26 can be controlled to be equal to the moving speed of the intermediate transfer belt 10 by controlling a rotational speed of the motor M2.

A description will now be given of an operation of the above-mentioned image forming apparatus in a case of $L=m+\alpha$ as an example.

(1) A latent image is formed on the photosensitive drum 16 of the first image station 14 by the charger 17 and writing means 18. The latent image on the photosensitive drum 16 is developed by the A color developing unit 19, and thereby a magenta toner image (hereinafter referred to as an M image) is obtained. The M image is transferred onto the intermediate transfer belt 10 by means of the first transfer brush 41.

(2) While the M image on the intermediate transfer belt 10 approaches the second image station 24 due to a movement of the intermediate transfer belt 10 in the direction indicated by the arrow a, a latent image is formed on the photosensitive drum 26 of the second image station 24 by the charger 27 and the writing means 28. The latent image on the photosensitive drum 26 is developed by the B color developing unit 29 and, thereby, a yellow toner image (hereinafter referred to as a Y image) is obtained. The Y image is transferred onto the M image so as to be superimposed thereon, which was transferred to the intermediate transfer belt 10 by the first image station 14, by means of the second transfer brush 42.

(3) While the superimposed M and Y images on the intermediate transfer belt 10 approach the first image station 14 due to a movement of the intermediate transfer belt 10 in the direction indicated by the arrow a, a latent image is formed on the photosensitive drum 16 of the first image station 14 by the charger 17 and the writing means 18. The latent image on the photosensitive drum 16 is developed by the C color developing unit 19 and, thereby, a cyan toner image (hereinafter referred to as a C image) is obtained. The C image is transferred onto the M, Y image on the intermediate transfer belt 10 by means of the second transfer brush 41.

(4) While the M, Y, C image on the intermediate transfer belt 10 approaches the second image station 24 due to the movement of the intermediate transfer belt 10 in the direction indicated by the arrow a, a latent image is formed on the photosensitive drum 26 of the second image station 24 by the charger 27 and the writing means 28. The latent image on the photosensitive drum 26 is developed by the D color developing unit 30 and, thereby, a black toner image (hereinafter referred to as a BK image) is obtained. The BK image is transferred onto the M, Y, C image so as to be superimposed thereon by means of the second transfer brush 42.

When a full color image is formed on the intermediate transfer belt 10 by the second transfer brush 42, a transfer paper P fed from the paper feed device is supplied to the transfer unit 45 by the pair of register rollers 44. Accordingly, the full color image is transferred onto the transfer paper P. The full color image on the transfer paper P is fixed by the fixing device 50, and the transfer paper P is ejected on the eject tray 53 by the eject rollers 54. On the other hand, residual toner remaining on the intermediate transfer belt 10 is removed by the cleaning device 61.

When a plurality of sheets are printed, an M image is transferred onto the intermediate transfer belt 10 by the first image station 14 when the Y image is transferred onto the M image at the second image station 24, and the process of the above-mentioned steps (1)–(4) is repeated.

As can be appreciated from the image forming process described with reference to FIGS. 2, 3 and 4, a development by the developing roller 32 and a development by the developing roller 33 are alternately performed in the first image station 14, and a development by the developing roller 34 and a development by the developing roller 35 are alternately performed in the second image station 24. When a developing roller is switched to another developing roller, the developing roller having been used is subjected to a so-called bristle cutting operation. The bristle cutting operation is a well-known technique to cancel a developing action of the developing roller having been used. The bristle cutting operation is achieved by reversing a rotation of the developing roller which has performed a developing operation.

In the image forming apparatus shown in FIG. 2, the developing rollers 32 and 33 of the first developing device in the first image station 14 are driven by the same drive power source. Additionally, the conveying screws 4M and 4C and paddles 2M and 2C are provided with the common drive power source. That is, power is supplied to the developing rollers 32 and 33, the conveying screws 4M and 4C and the paddles 2M and 2C by a common single developing unit driving system 63 (described later).

A description will now be given, of a mechanism in which the developing rollers 32 and 33, the conveying screws 4M and 4C and the paddles 2M and 2C are driven by a common single developing drive system and a bristle cutting operation can also be performed. It should be noted that the second developing device 8 of the second image station 24 has the same structure as the first developing device 6.

Figure 8:
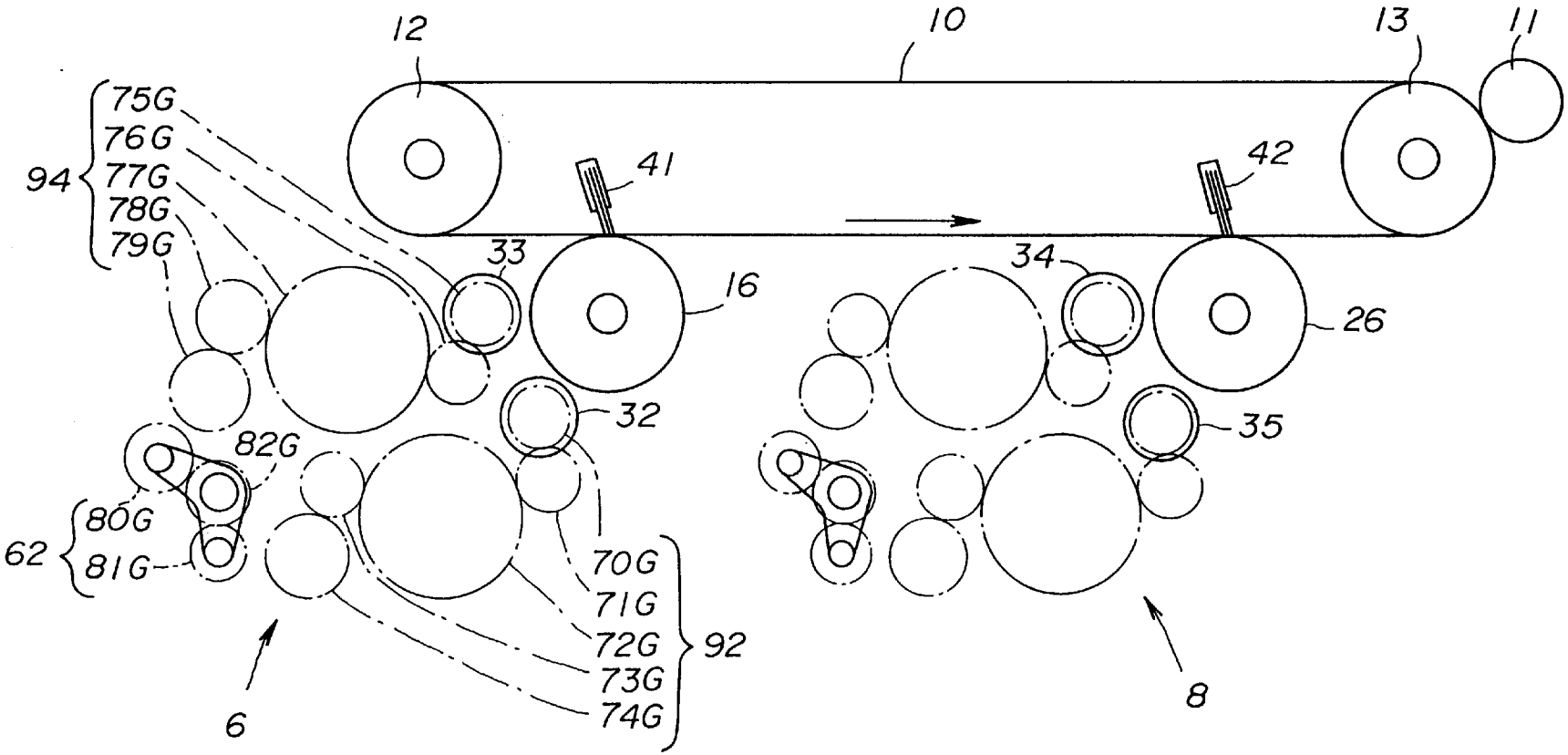
FIG. 8 is an illustration for explaining a driving-side power transmission mechanism and a driven-side power transmission mechanism.
Figure 9:
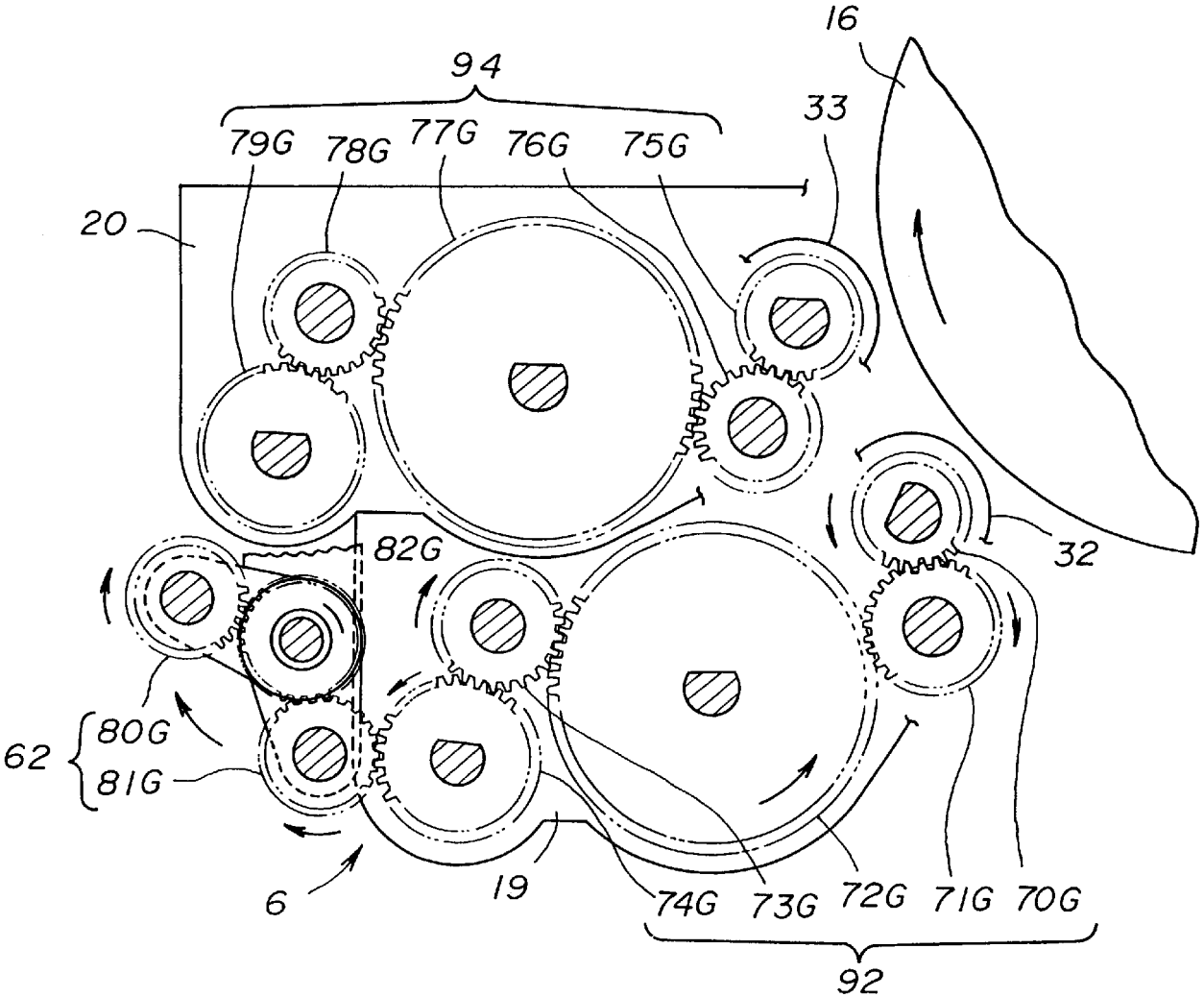
FIG. 9 is an illustration of a developing unit driving system and a switching mechanism.

FIG. 8 shows a power transmission system for the first and second developing devices 6 and 8. FIG. 9 shows a driving-side power transmission mechanism 62 and driven-side power transmission mechanisms 92 and 94 which are a final stage of the developing unit driving system 63 with respect to the first developing device 6. It should be noted that completely the same mechanism shown in FIG. 9 is provided to the second developing device 8.

In FIG. 8, tracing a power transmission path from the driven-side to the developing-side, a gear 70G is integrally provided to the developing roller 32, and an idle gear 71G is engaged with the gear 70G. Additionally, the idle gear 71G is engaged with a gear 72G which is integrally provided to the paddle 2M (refer to FIGS. 4 and 5). The gear 72G is engaged with an idle gear 73G which is engaged with a first gear 74G.

The first gear 74G is integrated with the conveying screw 4M (refer to FIGS. 4 and 5). As mentioned above, the first gear 74G is connected to the developing roller 32 via the gears 73G, 72G, 71G and 70G. These gears 70G, 71G, 72G and 73G are rotatably mounted to a side plate (indicated by the reference numeral 19 in FIG. 5) of the A color developing unit 19. The driven-side power transmission mechanism 92 is constituted by a train of these gears.

Similarly, a gear 75G is integrally provided to the developing roller 33, and an idle gear 76G is engaged with the gear 75G. Additionally, the idle gear 76G is engaged with a gear 77G which is integrally provided to the paddle 2C (refer to FIGS. 4 and 5). The gear 77G is engaged with an idle gear 78G which is engaged with a second gear 79G.

The second gear 79G is integrated with the conveying screw 4C (refer to FIGS. 4 and 5). As mentioned above, the second gear 79G is connected to the developing roller 33 via the gears 78G, 77G, 76G and 75G. These gears 75G, 76G, 77G and 78G are rotatably mounted to a side plate of the C color developing unit 20. The driven-side power transmission mechanism 94 is constituted by a train of these gears.

As shown in FIG. 9, the first gear 74G and the second gear 79G are provided with a predetermined interval therebetween so that the driving-side power transmission mechanism 62 is provided between the first gear 74G and the second gear 79G. The driving-side power transmission mechanism 62 is a part of the developing unit driving system 63 which selectively drives one of the developing rollers 32 and 33. The driving-side power transmission mechanism 62 comprises a gear 80G and a gear 81G. The gear 80G is engageable with the second gear 79G, and the gear 81G is engageable with the first gear 74G.

In a state shown in FIG. 9, the gear 81G is engaged with the first gear 74G, and the gear 80G is disengaged from the second gear 79G. When the driving-side power transmission mechanism 62 is swung toward the second gear 79G, the gear 80G is engaged with the second gear 79G, and the gear 81G is disengaged from first gear 74G. FIG. 8 shows a transit state in which both the gear 81G and the gear 80G are disengaged from the first gear 74G and the second gear 79G, respectively.

The gear 80G and the gear 81G are engaged with a gear 82G which is a part of the developing unit driving system 63. Accordingly, for example, when the gear 81G is engaged with the first gear 74G, the conveying screw 4M, the paddle 2M and the developing roller 32 are rotatable by a rotation of the gear 82G. On the other hand, when the gear 80G is engaged with the second gear 79G, the conveying screw 4C, the paddle 2C and the developing roller 33 are rotatable by a rotation of the gear 82G.

Figure 10:
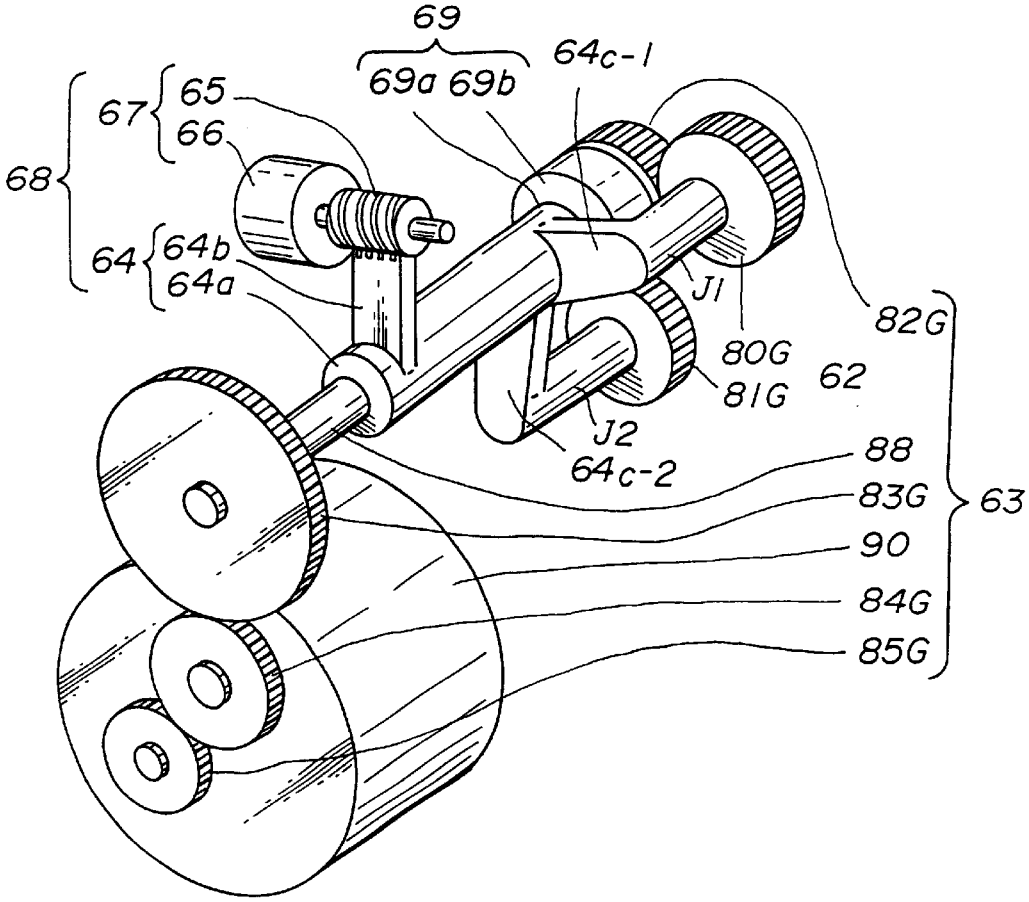
FIG. 10 is a perspective view of the developing unit driving system and the switching mechanism.

A description will now be given, with reference to FIGS. 8, 9 and 10, of a first embodiment of the present invention. FIG. 10 shows the developing unit driving system 63 and a switching mechanism 68. It should be noted that FIG. 10 shows the gears 80G and 81G viewed from the reverse side of FIG. 8 or 9, that is, viewed from the opposite side of the intermediate transfer belt 10 across a width of the intermediate transfer belt 10.

In FIG. 10, an arm 64*c*-1 and an arm 64*c*-2 are radially extended from an end of a cylinder portion 64*a*. The gear 80G is rotatably supported on an end of the arm 64*c*-1, and the gear 81G is rotatably supported on an end of the arm 64*c*-2. A power transmission shaft 88 is inserted into the cylinder portion 64*a* so that the power transmission shaft is rotatable relative to the cylinder portion 64*a*.

An end of the power transmission shaft 88 passes through the cylinder portion 64*a* and also passes through a sleeve 69. The gear 82G is mounted to the end of the power transmission shaft 88. The sleeve 69 rotatably supports the power transmission shaft 88, and an outer portion of the sleeve 69 is fixed to a stationary part of the image forming apparatus. Additionally, a gear 83G is mounted on the opposite end of the power transmission shaft 88. The gear 83G is engaged with a gear 84G which is engaged with a gear 85G. The gear 85G is fixed to a shaft of a developing roller drive motor 90.

According to the above-mentioned structure, the gears 82G, 80G and 81G are rotated by an operation of the developing roller drive motor 90. Additionally, the cylinder portion 64*a* is rotatable with respect to the power transmission shaft 88. When the cylinder portion 64*a* rotates, the gears 80G and 81G and the arms 64*c*-1 and 84*c*-2 rotate around the gear 82 serving as a sun gear.

Figure 11:
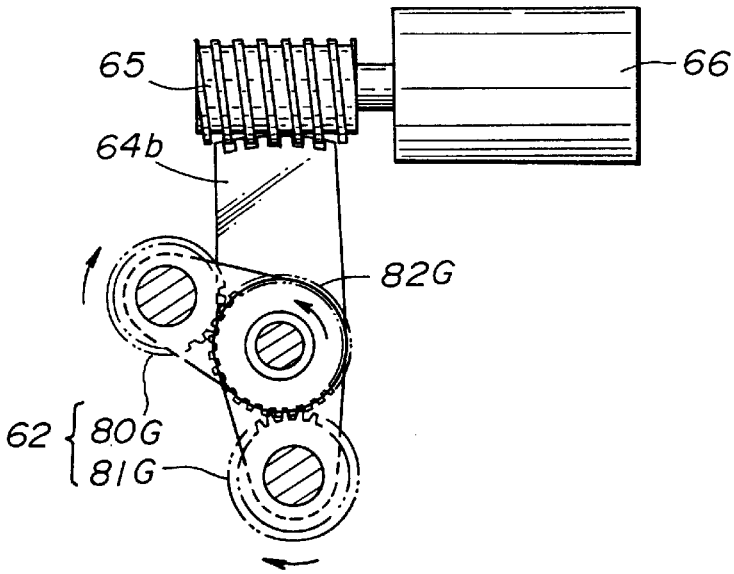
FIG. 11 is a front view of the developing unit driving system and the switching mechanism.

A segment gear 64*b* is integrally provided to a portion of the cylinder portion 64*a* on the side of the gear 83G. A shown in FIG. 11, the segment gear 64*b* is engaged with a worm gear 65 which is mounted on a rotational shaft of a developing roller switching motor 66 as a switching power source. A reversible motor is used for the developing roller switching motor 66.

The developing roller switching motor 66 is fixed on a stationary part of the image forming apparatus. Accordingly, by operating the developing roller switching motor 66 in a normal direction or a reverse direction while being engaged with the gear 82G, a switching can be performed between a state in which the gear 81G is engaged with the first gear 74G and the gear 80G is disengaged from the second gear 79G and a state in which the gear 81G is disengaged from the first gear 74G and the gear 80G is engaged with the second gear 79G.

In the above-mentioned structure, the driving:* side power transmission mechanism comprising the gear 80G and the gear 81G, the gear 82G, the power transmission shaft 88, the gear 83G, the developing roller driving motor 90, the gear 84G, and the gear 85G together constitute the developing unit driving system 63 which drives the developing rollers 32 and 33.

If a structure including the arms 64*c*-1, 64*c*-2 and the segment gear 64*b* which are integral with the cylinder portion 64*a* is referred to as a rotational member 64, the rotational member 64 supports the driving-side power transmission mechanism 62 comprising the gears 80G and 81G, and is driven by a rotational driving mechanism 67 comprising the worm gear 65 and the developing roller switching motor 66. A switching mechanism 68 for selectively switching a power of the developing unit driving system 63 to one of the developing rollers 32 and 33 is constituted by the rotational member 64 and the rotational driving mechanism 67.

As shown in FIGS. 8 and 9, the driven-side power transmission mechanisms 92 and 94 are located so that one of the mechanisms 92 and 94 is selectively connected to the driving-side power transmission mechanism 62 according to a position of the driving-side power transmission mechanism which rotates together with the rotational member 64. That is, positions of the gear 81G, the first gear 74G and the second gear 79G are determined so that the gear 81G is engaged with the first gear 74G and the gear 80G is disengaged from the second gear 79G when the rotational member 64 is at a predetermined position, and the gear 81G is disengaged from the first gear 74G and the gear 80G is engaged with the second gear 79G when the rotational member 64 is at different position.

As mentioned above, according to the present embodiment, a single developing unit driving system 63 is constituted together with the switching mechanism 68 and, thereby, the selective operation of the developing rollers 32 and 33 can be achieved with a simple structure occupying a small space. It should be noted that the second developing device 8, which has the same structure as the first developing device 6, has the same advantages.

Additionally, since the switching mechanism 68 has the rotational member 64 which supports the driving-side power transmission mechanism 62 and the rotational driving mechanism 67 which rotates the rotational member 64, and the rotational driving mechanism 67 has the reversible developing roller switching motor 66, the switching operation for the power transmission can be rapidly performed. Additionally, since the engagement between the worm gear 65 and the segment gear 64*b* receives a force which is received by the gears 80G and 81G during transmission of power so as to prevent the cylinder portion 64*a* from being moved in a direction of rotation, the position of the driving-side power transmission mechanism 62 is positively maintained. Further, since the cylinder portion 64*a* is rotatable about the power transmission shaft 88 which serves as an axis of rotation and a power transmitting member, the simple structure is achieved.

Figure 12:
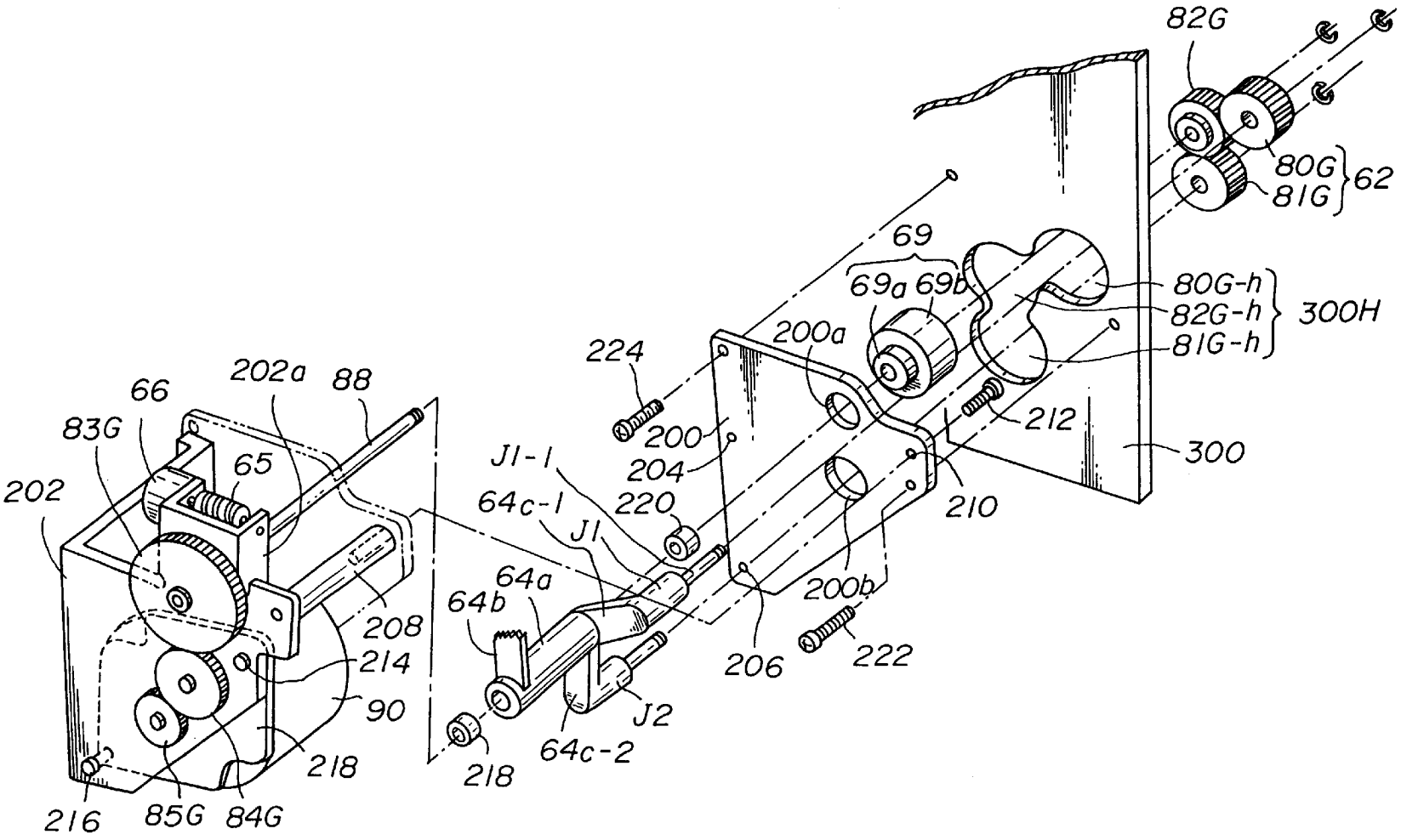
FIG. 12 is an exploded perspective view of the developing unit driving system and the switching mechanism which are formed in a single unit.

A description will now be given of a variation of the first embodiment. FIG. 12 is an exploded perspective view of the developing unit driving system 63 and the rotational driving mechanism 67 which are formed as one unit.

In FIG. 12, a frame 200 and a frame 202 which is bent into an L shape constitute a frame member of a unit which has a predetermined space. The abovementioned developing unit driving system 63 and the switching mechanism 68 are assembled and accommodated in the space of the unit. The frame 200 and the frame 202 are assembled by screws (not shown in the figure) which are inserted into mounting holes 204 and 206 formed in the frame 200 and also by a screw 212 screwed into a shaft member 208 via a mounting hole 210 formed in the frame 200.

The developing roller drive motor 90 is mounted to an inner wall of the frame 202 via a support plate 218 by mounting screws 214 and 216. An end of the rotational shaft of the developing roller drive motor 90 protrudes outside the frame 202, and the gear 85G is mounted on the end of the rotational shaft. Additionally, the gear 84G is rotatably supported by a shaft mounted on the frame 202. The power transmission shaft 88 extends through the frame 202 via a bearing, and the gear 83G is mounted on a portion of the power transmission shaft 88 which protrudes outside the frame 202. As mentioned above, the gear 83G is engaged with the gear 84G.

A mounting portion 202*a* having a channel shape is integrally formed with an upper portion of the frame 202. The worm gear 65 is rotatably supported in a space between opposite walls of the mounting portion 202*a*. The developing roller switching motor 66 is mounted on an outer wall of the mounting portion 202*a*, and the shaft of the motor 66 is connected to the worm gear 65.

The power transmission shaft 88 is rotatably supported by the frame 202 so that the shaft 88 does not move in the longitudinal direction of the shaft 88. The cylinder portion 64*a* fits on a portion of the power transmission shaft 88 which is located inside the frame 202. The power transmission shaft 88 is rotatably supported by bearings 218 and 220 provided on opposite ends of the cylinder portion 64*c*. On the other hand, a small diameter portion 69*a* of the sleeve 69 is fixedly inserted into a hole 200*a* formed in the frame 200 from outside the frame 200. A boss surface of the small diameter portion 69*a* slightly protrudes from an inner wall of the frame 200 towards the inside and contacts an end of the cylinder portion 64*a* so as to determine a position of the cylinder portion 64*a* in the longitudinal direction thereof. The opposite end of the cylinder portion 64*a* contacts the inner wall of the frame 202 via a ring-like slide member (not shown in the figure).

As mentioned-above, the segment gear 64*b* which is integral with the rotational member 64 is engaged with the worm gear 65. The power transmission shaft 88 extends through an axis hole of the sleeve 69, and the gear 82G is mounted on an end of the shaft 88 by being prevented from rotation by a key.

The arm 64*c*-1 has a stem portion J1 parallel to the cylinder portion 64*a*. The stem portion J1 extends slightly above the frame 200 and protrudes outside the frame 200. The gear 80G is rotatably mounted to a gear mounting shaft J1-1 which extends from the stem portion J1.

The arm 64*c*-2 has a stem portion J2 parallel to the cylinder portion 64*a*. The stem portion J2 extends through an opening 200*b* formed in the frame 200 and protrudes outside the frame 200, the opening 200*b* having a sufficient size for movement of the stem portion J2. The gear 81G is rotatably mounted to a gear mounting shaft J2-2 which extends from the stem portion J2. It should be noted that the size of the opening 200*b* is determined so that the stem portion J2 is movable within the opening 200*b* in response to a switching operation of the power transmission.

The sleeve 69 has a large diameter portion 69*b* on an outer side of the small diameter portion 69*a*. The diameter of the large diameter portion 69*b* is greater than a diameter of a top teeth circle of the gear 82G. In the present embodiment, the gears 80G, 81G and 82G are identical to each other. In the thus-formed unit, the large diameter portion 69*b* and the gears 80G, 81G and 82G are positioned on the outside of the frame 200.

In FIG. 12, the unit is mounted to a side plate 300 of a body of the image forming apparatus. The side plate 300 is opposite to the side plate 19 shown in FIG. 5. The side plate is provided with an opening 300H which allows the gears 80G, 81G and 82G to pass therethrough. The opening 300H comprises an opening 80G-*h* corresponding to the gear 80G, an opening 81G-*h* corresponding to the gear 81G and an opening 82G-*h* corresponding to the gear 82G. Since the openings 80G-*h*, 81G-*h* and 82G-*h* are close to each other, the openings are connected resulting in the opening 300H.

Figure 13:
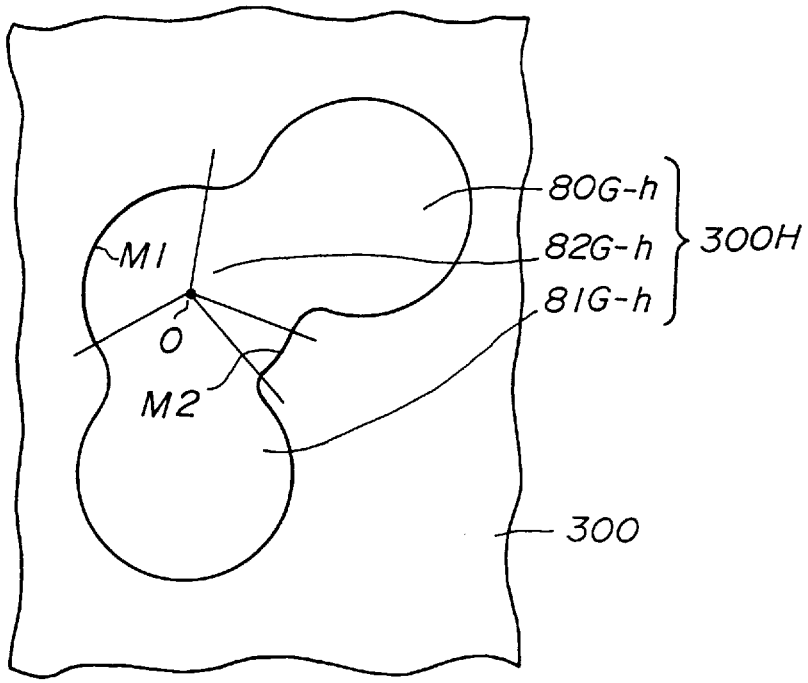
FIG. 13 is a front view of an opening for mounting the unit shown in FIG. 12.

Referring to FIG. 13, the opening 82G-*h* serves a function to determine a position of the driving-side power transmission mechanism 62 relative to the driven-side power transmission mechanisms 92 and 94 by receiving the large diameter portion 69*b* of the sleeve 69. That is, the opening 82G is formed so that the position of the gear 82G is determined. Accordingly, portions M1 and M2 of an inner side of the opening 82G-*h* is formed as parts of a circle having a center O which circle corresponds to the large diameter portion 69*b* of the sleeve 69.

Figure 14:
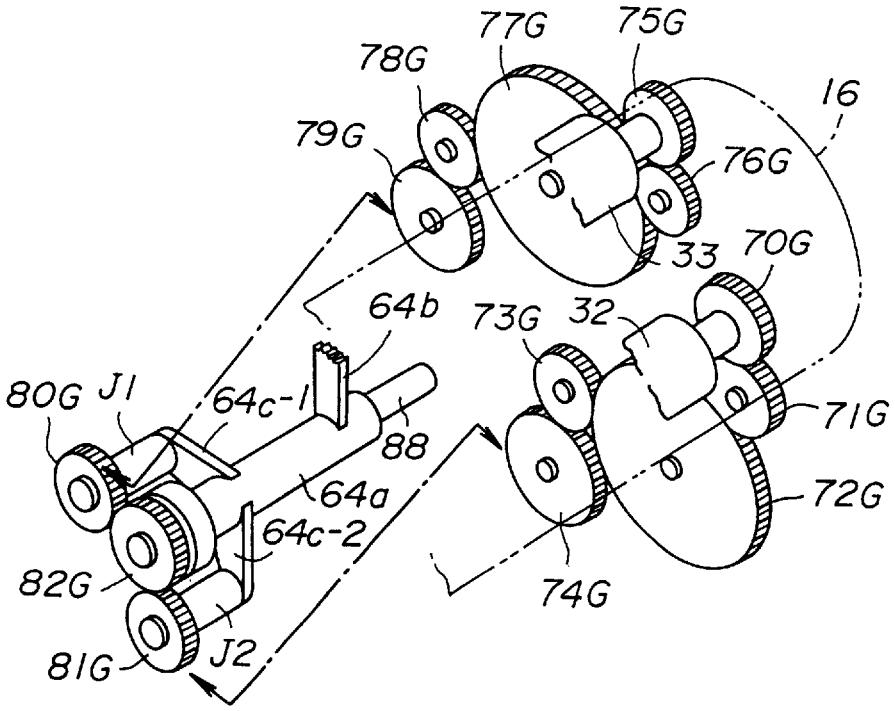
FIG. 14 is a perspective view of the driving-side power transmission mechanism and the driven-side power transmission mechanism.

Accordingly, the position of the center of the gear 82G relative to the side plate 300 is determined by fitting the large diameter portion 69*b* to the opening 82G-*h*. An angular position of the unit can be easily determined by the positional relationship between the driving-side power transmission mechanism 62 and the driven-side power transmission mechanisms 92 and 94. After the position of the unit is determined, the frame 200 is fixed to the side plate 300 by the screws 222 and 224. Accordingly, a positional relationship between the gears and the members is determined as shown in FIG. 14. Additionally, the positional relationship between the driving-side power transmission mechanism 62 and the driven-side power transmission mechanisms 92 and 94 can be positively and easily established, and an efficient assembling operation can be achieved.

A description will now be given of a second embodiment of the present invention. In the second embodiment, the rotational driving mechanism 67 shown in FIG. 10 is replaced by a cam drive mechanism.

Figure 15:
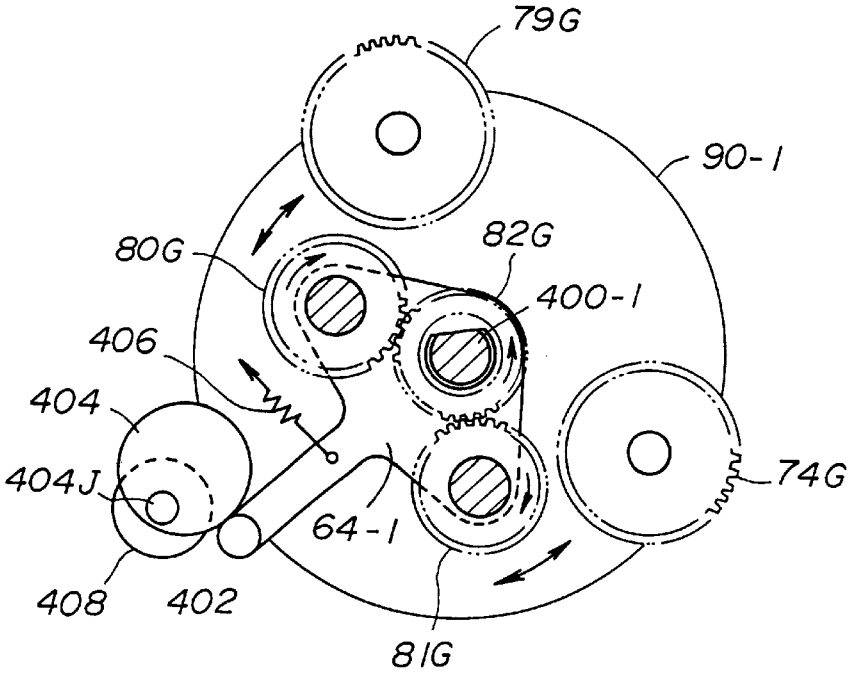
FIG. 15 is a front view of a rotationally driving mechanism using a cam.

FIG. 15 is a part of an image forming apparatus according to the second embodiment of the present invention. In FIG. 15, the gear 82G is directly connected to a rotational shaft 400-1 of a developing roller driving motor 90-1. The rotational shaft 400-1 serves as a center of rotation of a rotational member 64-1. The gears 80G and 81G are engaged with the gear 82G. The gear 81G is engaged with the first gear 74G and the gear 80G is disengaged from the second gear 79G when the rotational member 64-1 is at a predetermined position. On the other hand, the gear 81G is disengaged from the first gear 74G and the gear 80G is engaged with the second gear 79G when the rotational member 64-1 is rotated to a different position.

In order to perform such a switching operation, a cam follower 402 and an eccentric cam 404 are provided. The cam follower 402 is mounted on an end of an arm portion of the rotational member 64-1, the arm portion extending in a radial direction of the rotational shaft 400-1. The cam follower 402 is pressed against the eccentric cam 404 by an elastic force of a spring 406. The eccentric cam 404 has a shaft 404J which is rotated by a motor 408 serving as a switching power source.

According to the above-mentioned structure, the gears 80G and 81G can be selectively engaged with or disengaged from the first gear 74G and the second gear 79G by rotating (swinging) the rotational member 64-1 in accordance with an angular position of the eccentric cam 404.

It should be noted that although the gear 82G is directly connected to the rotational shaft of the developing roller driving motor 90-1, the rotational force may be transmitted to the rotational shaft 400-1 via the gears 85G, 84G and 83G as explained in the first embodiment with reference to FIG. 10.

Figure 16:
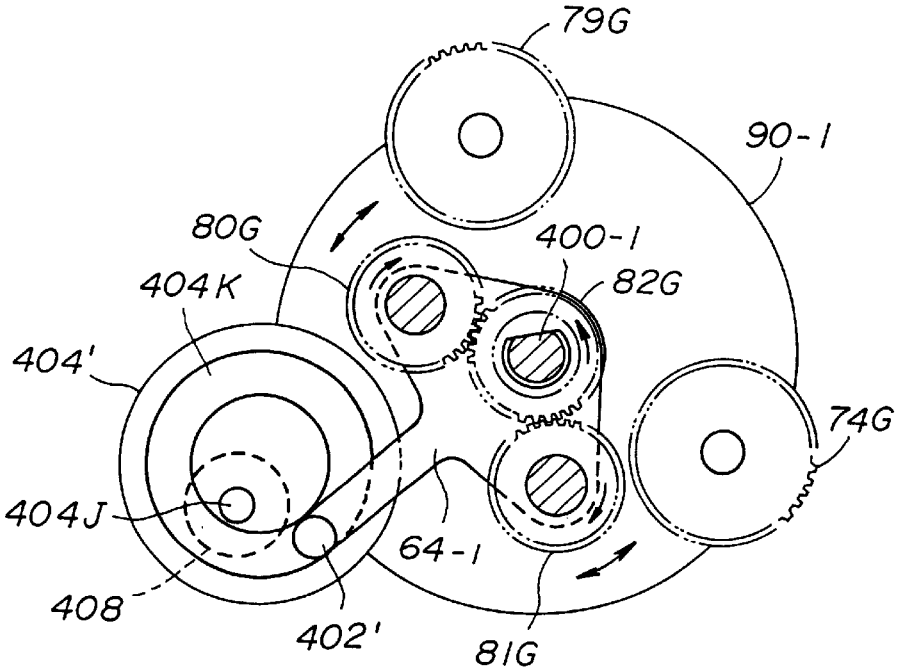
FIG. 16 is a front view of a variation of the rotational driving mechanism shown in FIG. 15.

A description will now be given, with reference to FIG. 16, of a variation of the second embodiment. This variation has the same structure as that of the structure shown in FIG. 15 except for an eccentric cam 404' and a cam follower 402' being replaced for the eccentric cam 404 and the eccentric cam 402 shown in FIG. 15. The eccentric cam 404' has an annular guide groove 404K which guides the cam follower 402'. The cam follower 402' comprises a cylindrical protrusion which fits the guide groove 404K. Since the cam follower 302' is maintained in the guide groove 404K, there is no need to provide the spring 406 shown in FIG. 15. Additionally, the movement of the cam follower 402' is restricted by the guide groove 404K, the engagement of the gears 80G and 81G with the first gear 74G and the second gear 79G is maintained in a stable condition.

Figure 17:
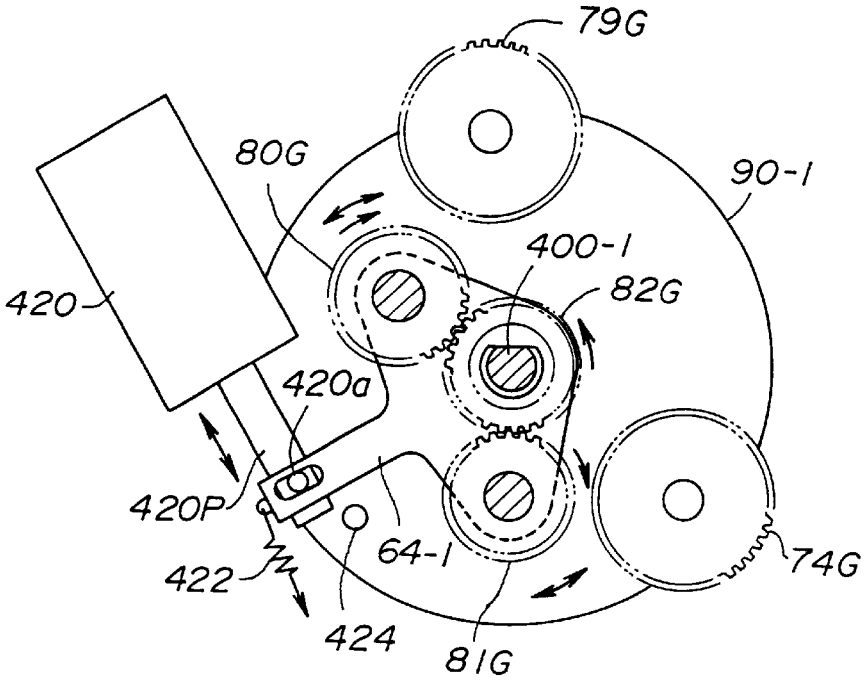
FIG. 17 is a front view of a rotationally driving mechanism using a solenoid actuator.

A description will now be given of a third embodiment of the present invention. FIG. 17 shows a part of an image forming apparatus according to the third embodiment of the present invention. A structure shown in FIG. 17 has a solenoid actuator 420 instead of the cam mechanism shown in FIG. 15. A pin 420*a* formed on an end of a plunger 420P of the solenoid 420 is engaged with a slot 64-1*a* formed on an arm portion extending from the rotational member 64-1. Additionally, the arm portion of the rotational member 64-1 is provided with a spring 422 which urges the plunger 420P in a direction in which the plunger 422 is pulled out.

When the solenoid actuator 420 is turned on, the plunger 420P is pulled in and the rotational member 64-1 is rotated so that the gear 80G is engaged with the second gear 79G and the gear 81G is disengaged from the second gear 74G. When the solenoid actuator 420 is turned off, the rotational member 64-1 is reversely rotated and is put in contact with a stopper 424 so that the gear 80G is disengaged from the second gear 79G and the gear 81G is engaged with the second gear 74G.

Figure 18:
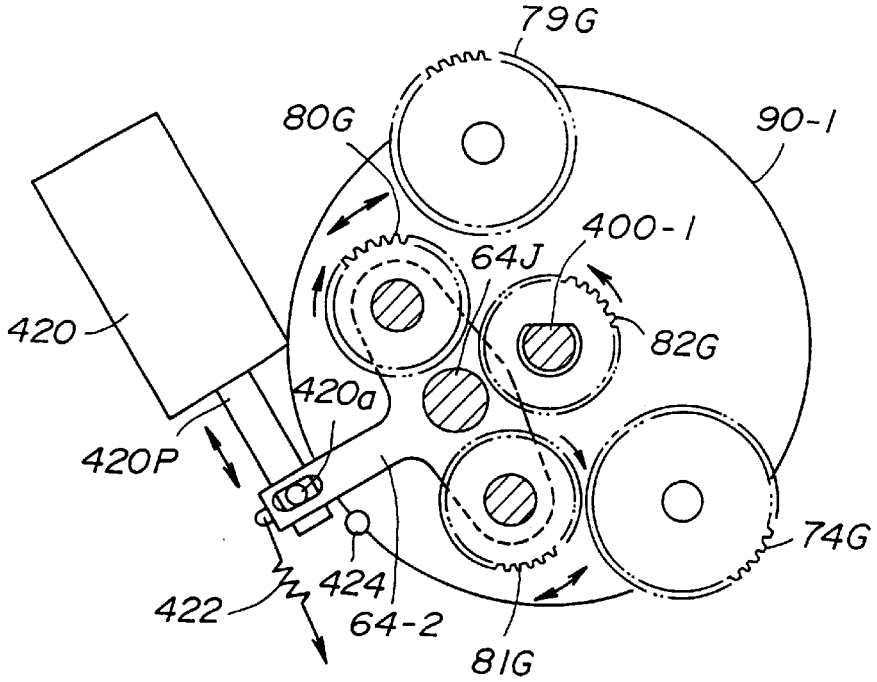
FIG. 18 is a front view of a variation of the rotational driving mechanism shown in FIG. 17.
Figure 19:
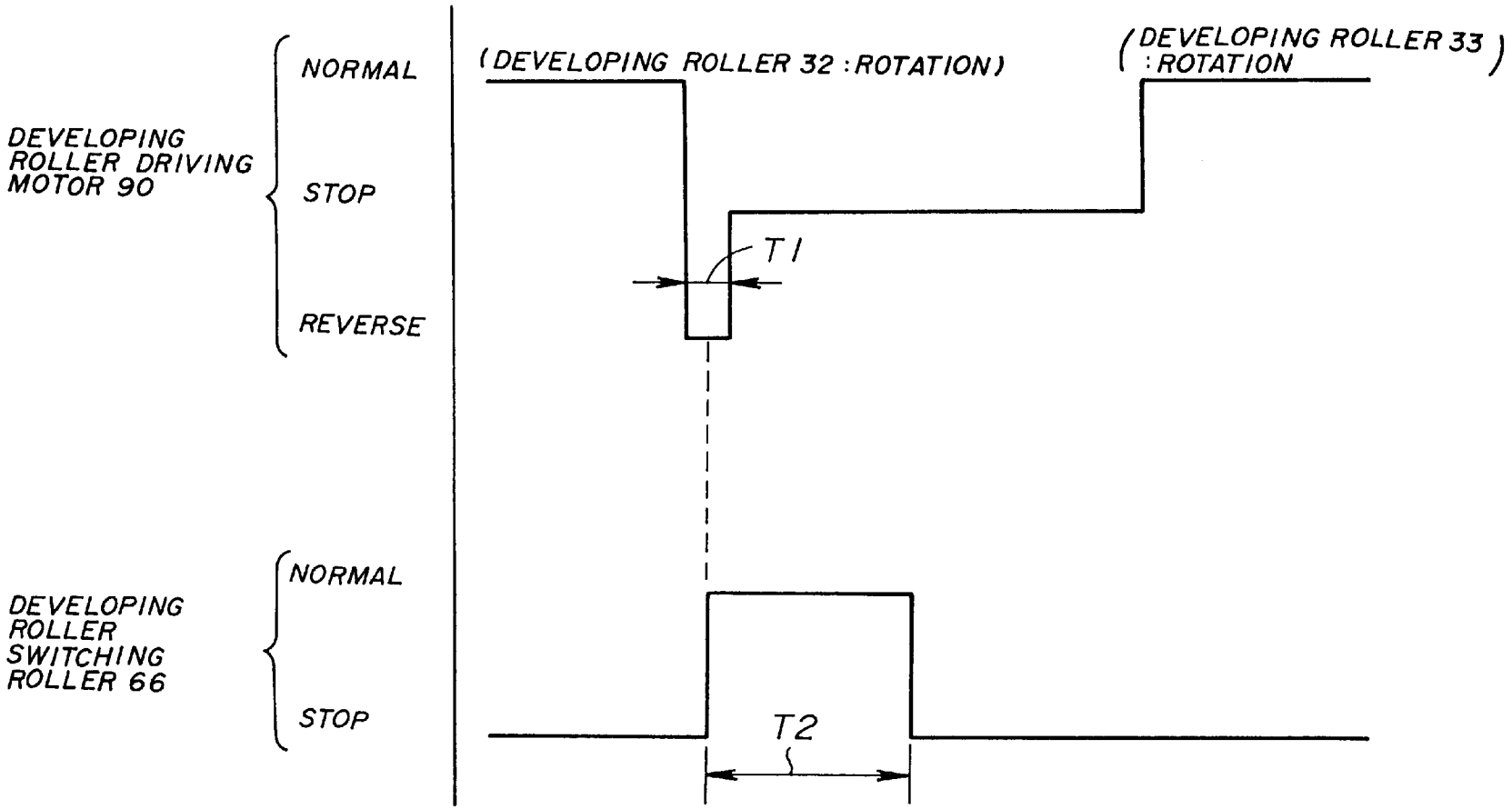
FIG. 19 is a timing chart for explaining timing for switching developing rollers.

FIG. 18 shows a variation of the third embodiment shown in FIG. 17. In this variation, the center of rotation of the rotational member 64-1 is changed from the rotational shaft 400-1 of the developing roller driving motor 90-1 to a rotational shaft 64J shown in FIG. 18. Other parts are the same as the parts shown in FIG. 17. Since the center of rotation is different from the center of the gear 82G, the gear 80G can be engaged with or disengaged from both the second gear 79G and the gear 82G substantially at the same time. Similarly, the gear 81G can be engaged with or disengaged from both the first gear 74G and the gear 82G substantially at the same time.

It should be noted that the spring 422 and the stopper 424 may be supplementary parts of the solenoid actuator 420.

In the present embodiment, since the solenoid actuator is used as a rotational driving mechanism, a switching mechanism is easily achieved.

In the above-mentioned embodiments and variations according to the present invention, the image forming apparatus comprises the first and second image stations 14 and 24 which are arranged along the same intermediate transfer belt 10. The first image station 14 comprises the two developing rollers 32 and 33 and the photosensitive drum 16, and the second image station 24 comprises the two developing rollers 34 and 35 and the photosensitive drum 26.

Additionally, in the first image station 14, the single developing unit driving system 63 drives both the developing rollers 32 and 33. The developing unit driving system 63 comprises the driving-side power transmission mechanism 62, the developing roller driving motor 90, the train of gears 85G, 84G, 83G and 82G and the power transmission shaft 88. The second image station 24 has the same structure as the first image station 14.

Since the developing unit driving system 63 is constituted by the developing roller drive motor 90 and the train of gears connected to the motor 90, the developing unit driving system 63 as a power source of the developing rollers 32 and 33 can be achieved with a simple structure.

Additionally, as shown in FIGS. 8, 9 and 14, the rotational member 64 and the rotational driving mechanism 67 which rotates the rotational member 64 are provided as the switching mechanism 68 which selectively switches transmission of power to one of the developing rollers 32 and 33. The driving-side power transmission mechanism 62 comprising the gears 80G and 81G which are the final stages of the developing unit driving system 63 is provided to a part of the rotational member 64. The gear 80G is engageable with the second gear 79G as the driven-side power transmission mechanism 92, and the gear 81G is engageable with the first gear 74G as the driven-side power transmission mechanism 94.

The second gear 79G is engaged with the idle gear 78G which is engaged with the gear 77G. The gear 77G is engaged with the gear 76G which is engaged with the gear 75G which is connected to the developing roller 33. Similarly, the first gear 74G is engaged with the idle gear 73G which is engaged with the gear 72G. The gear 72G is engaged with the gear 71G which is engaged with the gear 70G which is connected to the developing roller 32.

As mentioned above, each of the driving-side power transmission mechanism and the driven-side power transmission mechanism is constituted by a combination of gears. Since the transmission of power is switched by engagement or disengagement of the gears, a simple and reliable control of the developing process can be achieved.

When the developing roller driving motor 90 is operated, the rotational force is transmitted in the order of the gear 85G→the gear 84G→the gear 83G the gear 82G. Since both the gear 80G and the gear 81G are engaged with the gear 82G, the gears 80G and 81G rotate in the same direction when the gear 82G rotates. Accordingly, the gear 70G (the developing roller 32) and the gear 75G (the developing roller 33) are rotated in the same direction since the gears 70G and 75G are connected to the respective gears 80G and 81G by the same number of gears therebetween. Accordingly, when the developing roller driving motor 90 is rotated in a normal direction, the developing rollers 32 and 33 are rotated in the direction appropriate for development. On the other hand, if the developing roller driving motor 90 is rotated in a reverse direction, the rollers 32 and 33 can be reversely rotated which is appropriate for a bristle cutting operation.

In FIG. 9, if the photosensitive drum 16 is rotated in the clockwise direction during an image forming process, the developing rollers 32 and 33 should be rotated in the counterclockwise direction for development. Accordingly, if the gear 81G is engaged with the first gear 74G by the switching mechanism 68 and the developing roller driving motor 90 is rotated in the normal direction so that the rotation of the developing roller 32 is rotated in the direction appropriate for development, the developing roller 33 can also be rotated in the direction appropriate for development by operating the switching mechanism 68 so as to engage the gear 80G with the second gear 79G and rotating the developing roller driving motor 90 in the normal direction.

Accordingly, when the developing roller driving motor 90 is rotated in the normal direction, the developing rollers 32 and 33 are rotated in the direction appropriate for development, and when the developing roller driving motor 90 is rotated in the reverse direction, the developing rollers 32 and 33 are rotated in the reverse direction in which a bristle cutting operation can be performed. This condition can be established also in the driving-side power transmission mechanism 62. That is, if a direction of rotation of each of the gears in the driving-side power transmission mechanism 62 achieved when the developing rollers 32 and 33 are rotated in the direction for development is referred to as a normal direction, each gear of the driving-side power transmission mechanism 62 should be rotated in a reverse direction so that the developing rollers 32 and 33 perform a bristle cutting operation.

A degree of reverse rotation for a bristle cutting operation may vary for various conditions. In the image forming apparatus according to the present invention, a 90-degree reverse rotation is adopted. As mentioned above, by providing the switching mechanism 68, development by the two developing rollers can be achieved.

In the image forming apparatus shown in FIG. 4, the developing unit driving system 63 and the switching mechanism 68 shown in FIGS. 10 to 14 are used in the first developing device 6, and the same structure is used in the second developing device 8. Accordingly, the first developing device 6 and the second developing device 8 having the same structure are arranged along the same intermediate transfer belt 10.

In the image forming apparatus shown in FIG. 4, the first image station 14 and the second image station 24 alternately perform a formation of a latent image and development of the latent image. For example, as for the first sheet, development is performed in an order of "developing roller 32→developing roller 34→developing roller 33→developing roller 35"; as for the second sheet, development is performed in an order of "developing roller 32→developing roller 34→developing roller 33→developing roller 35"; and as for the third sheet, development is performed in an order of "developing roller 32→developing roller 34→developing roller 33→developing roller 35".

In the above-mentioned case, with respect to the first developing device 6, switching of the developing rollers is performed alternately in an order of "developing roller 32→developing roller 33"→"developing roller 32→developing roller 33"→. . . . When the switching is performed from the developing roller 32 to the developing roller 33, the developing roller 32 is reversed so as to perform a bristle cutting operation. Additionally, when the switching is performed from the developing roller 33 to the developing roller 32, the developing roller 33 is reversed so as to perform a bristle cutting operation.

With respect to the second developing device 8, switching of the developing rollers is performed alternately in an order of "developing roller 34→developing roller 35"→"developing roller 34→developing roller 35"→. . . . When the switching is performed from the developing roller 34 to the developing roller 35, the developing roller 34 is reversed so as to perform a bristle cutting operation. Additionally, when the switching is performed from the developing roller 35 to the developing roller 34, the developing roller 35 is reversed so as to perform a bristle cutting operation.

In the image forming apparatus shown in FIG. 4, when the switching from the developing roller 32 to the developing roller 33 is performed, the developing roller driving motor 90 is temporarily reversed for a predetermined period T1 so as to perform a bristle cutting operation with respect to the developing roller 32. Then, the developing roller switching motor 66 is started to rotate in a normal direction during the period T1. According to the rotation of the motor 66, the rotational member 64 is rotated in the clockwise direction in FIG. 10, and thus the gear 81G is disengaged from the first gear 74G and the gear 80G is engaged with the second gear 79G.

The second gear 79G which is adapted to be engaged with the gear 80G is not rotated until the second gear 79G is put in engagement with the gear 80G. If the gear 80G is not rotated when put in engagement with the second gear 79G, it is possible that the gear 80G and the second gear 79G cannot be engaged with each other since a top of a tooth of the gear 80G may contact a top of a tooth of the second gear 79G. In this respect, in the present invention, the gear 80G is put in engagement with the second gear 79G while the gear 80G is rotated due to a rotation of the gear 82G for a bristle cutting of the developing roller 32. Accordingly, the gear 80G can be positively engaged with the second gear 79G since a top of a tooth of the gear 80G moves to the bottom of the tooth of the second gear 79G. After the period T1 has passed, the developing roller driving motor 90 stops, and waits for a developing operation by the developing roller 33. When the developing operation is started, the motor 90 is rotated in the normal direction.

The above-mentioned control in which the switching operation of the switching mechanism 68 is performed while the driving-side power transmission mechanism 62 is reversely operated for a bristle cutting operation is performed by a control means 100 shown in FIG. 6. The control means includes a CPU and a timing signal generating circuit. The control means also controls the image forming process performed by the image forming apparatus shown in FIG. 4.

In FIG. 6, signals input to the control means 100 include a mark detection signal S1 for an intermediate transfer member, a print ON signal S2 and an output of a clock oscillator, but are not limited to these three signals. The mark detection signal S1 is output from a belt mark detecting sensor 102 shown in FIG. 4. A belt mark is provided on an inner surface of the intermediate transfer belt 10. The sensor 102 detects the belt mark for each complete rotation of the intermediate transfer belt 10, and sends the mark detection signal S1 to the CPU 100.

The print ON signal S2 is output when a print switch on an operational panel of the image forming apparatus is turned on, or may be output from a personal computer (not shown in the figures) connected to the image forming apparatus. The image forming process is started when the print ON signal S2 is input. The output of the clock oscillator is used as a reference signal for determining various timing for the image forming process. An output of the control means 100 includes, as shown in FIG. 6, signals related to a control of an entire apparatus, signals related to a control of the first image station 14 and signals related to a control of the second image station 24.

As a destination of the signals related to a control of the entire apparatus, there is a driving means 104 of the cleaning device 10 for the intermediate transfer belt 10. The driving means 104 is controlled by the signals output from the control means 100. The moving means 104 moves the cleaning device 61 so as to remove toner remaining on the intermediate transfer belt 10. As destinations of the signals related to the first image station 14, there are the writing means 18, the developing roller driving motor 90, the switching mechanism 68 and the first transfer brush moving mechanism 106. Similarly, as destinations of the signals related to the second image station 24, there are the writing means 28, the developing roller driving motor 90, the switching mechanism 68 and the first transfer brush moving mechanism 106.

A description will now be given, with reference to FIG. 20, of the image forming process performed by the image forming apparatus shown in FIG. 4. In the image forming process, it is assumed that a length of the intermediate transfer belt 10 is less than twice a length of a transfer paper P to be used, and each sheet is printed per two turns of the intermediate transfer belt 10.

Figure 20:
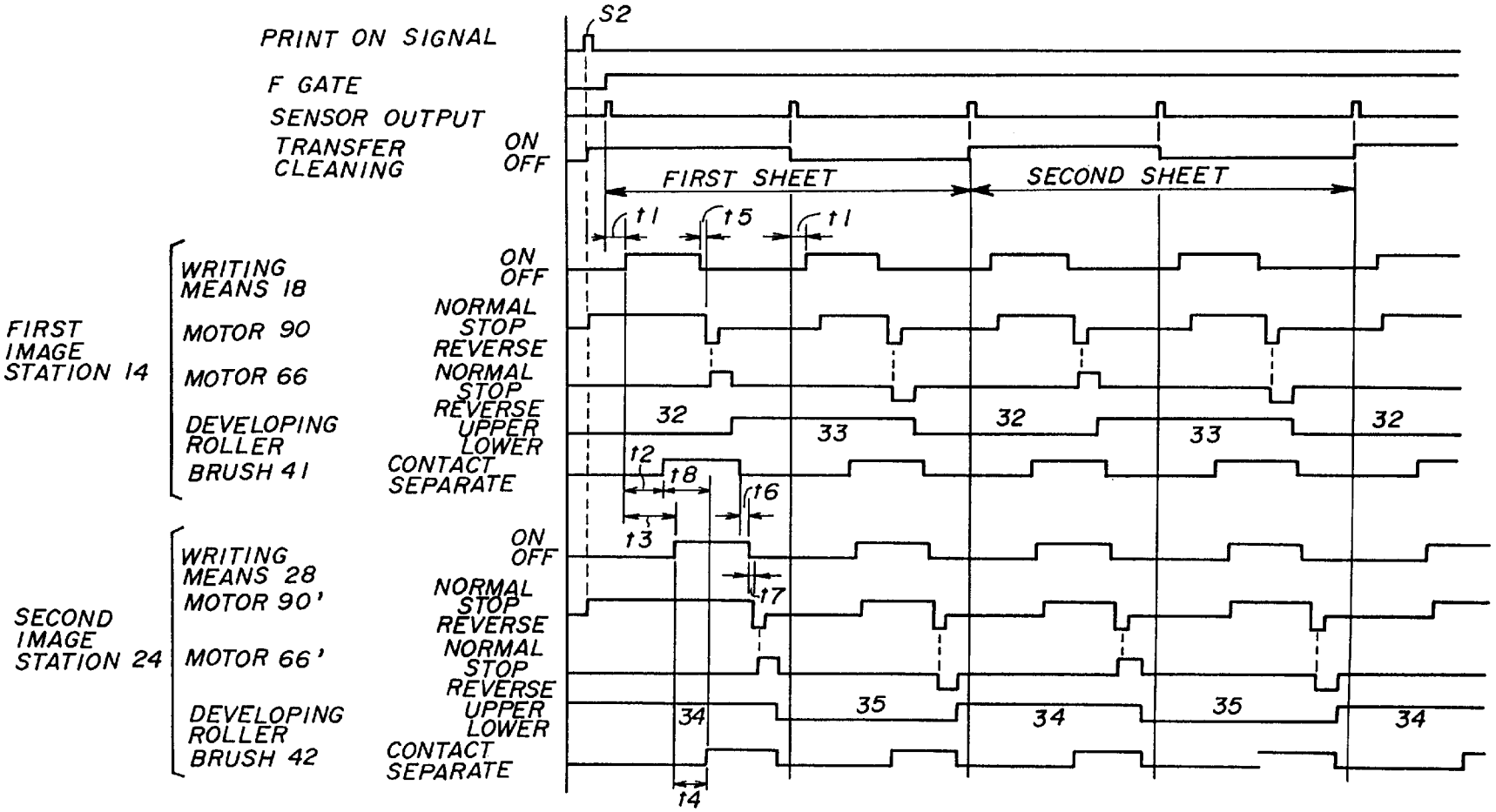
FIG. 20 is a timing chart for explaining operations of each member in two image stations shown in FIG. 4.
Figure 21:
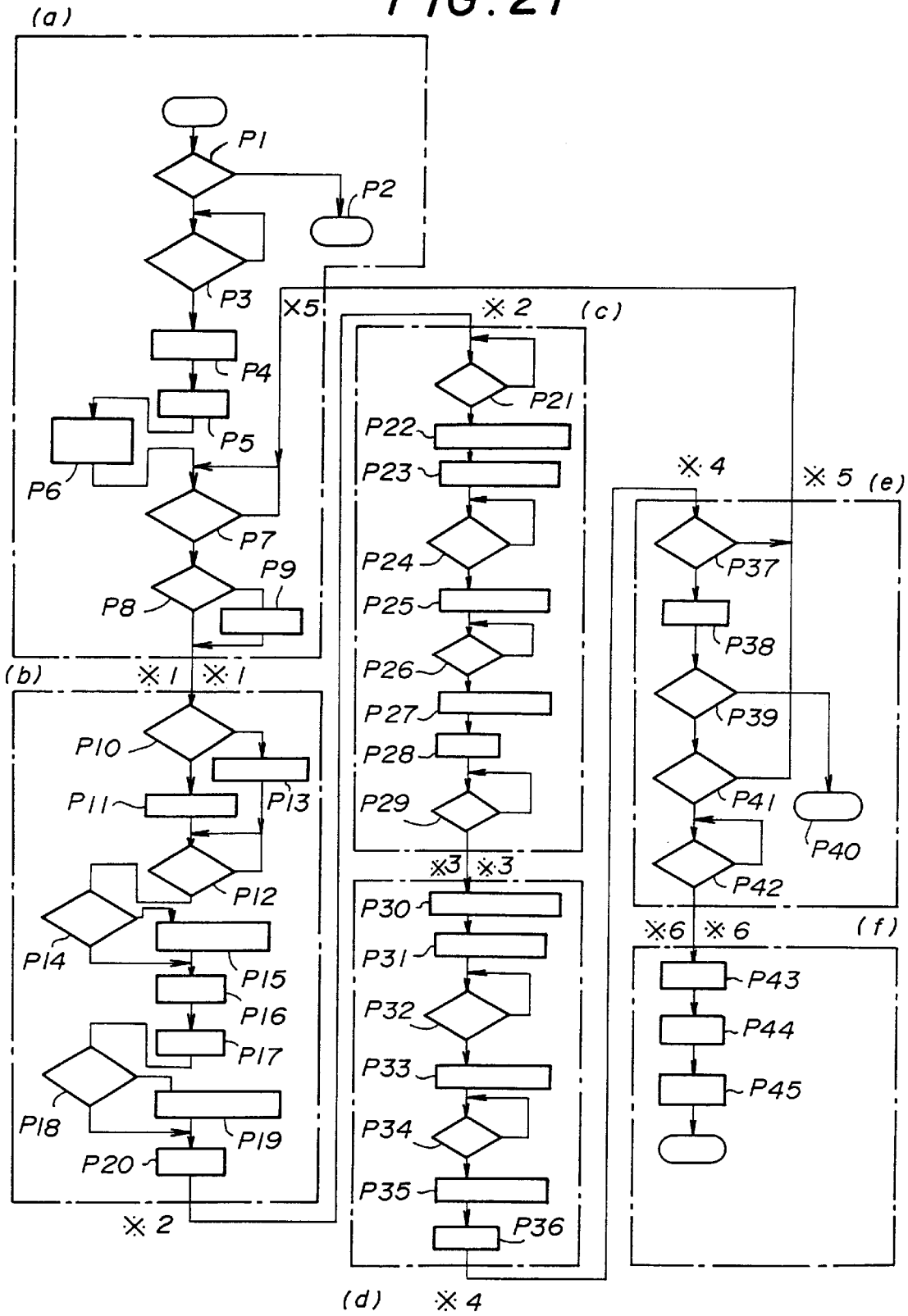
FIG. 21 is a flowchart of an entire image forming operation performed by the image forming apparatus shown in FIG. 4.
Figure 22:
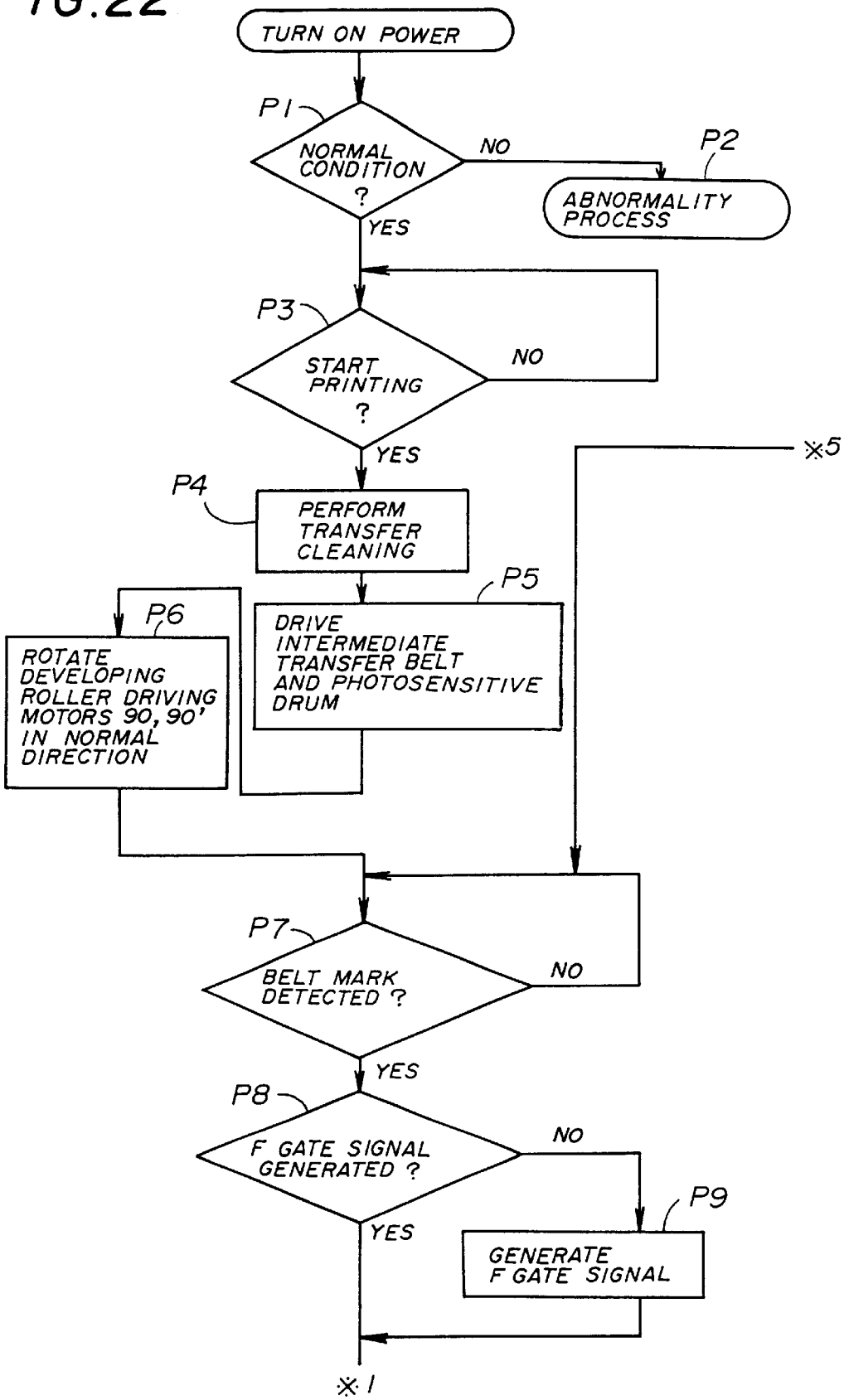
FIG. 22 is a part of the flowchart shown in FIG. 21.
Figure 23:
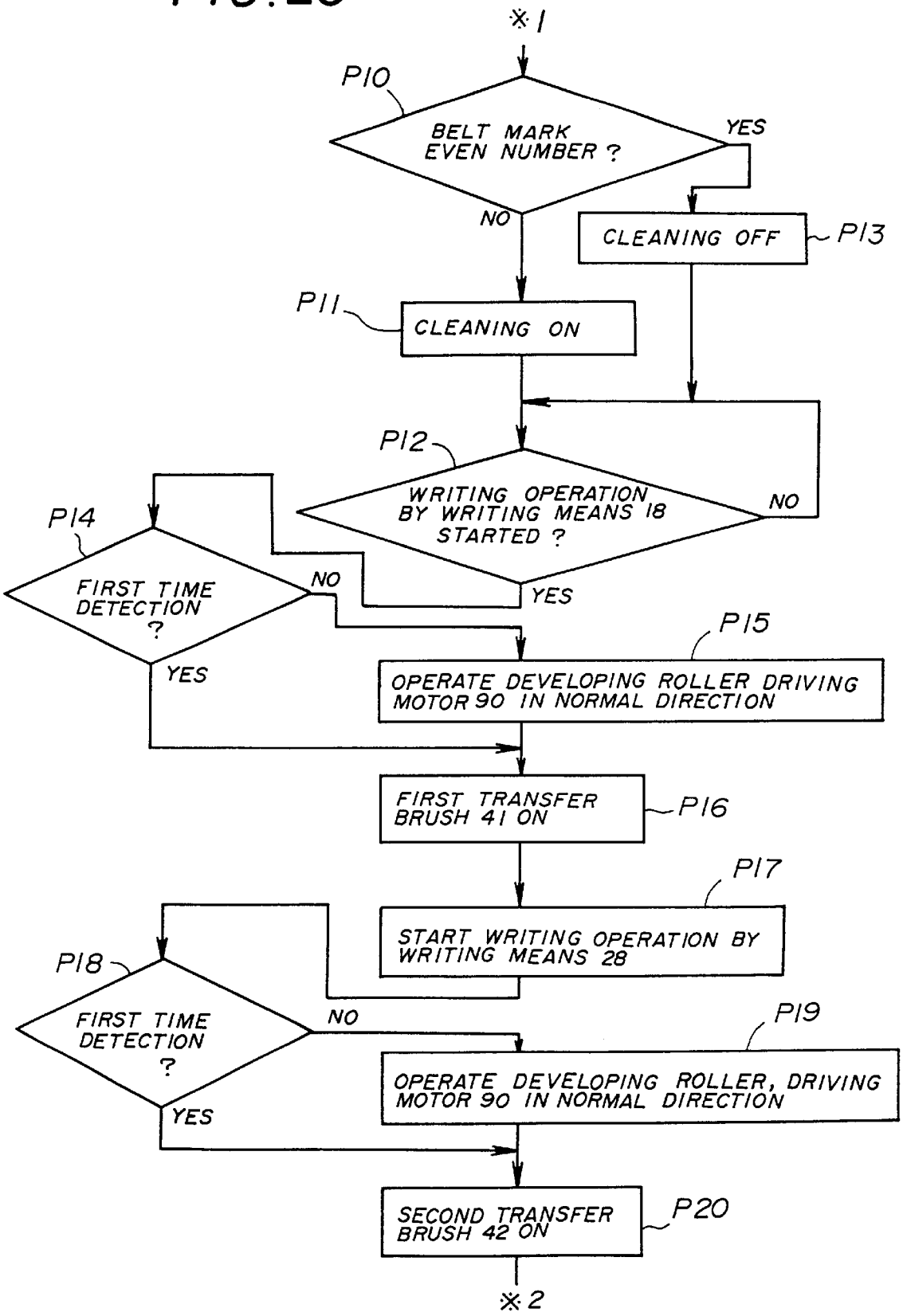
FIG. 23 is a part of the flowchart shown in FIG. 21.
Figure 24:
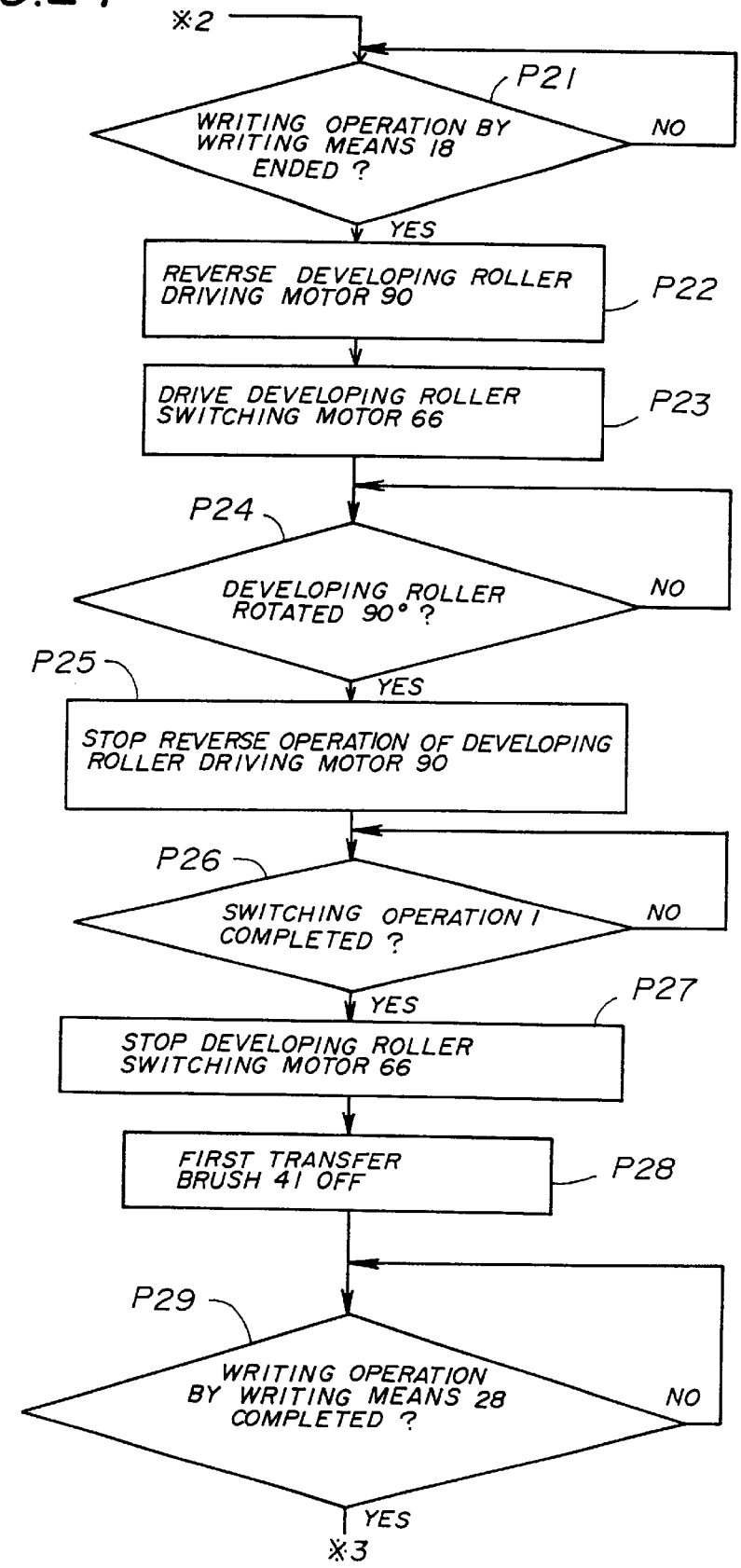
FIG. 24 is a part of the flowchart shown in FIG. 21.
Figure 25:
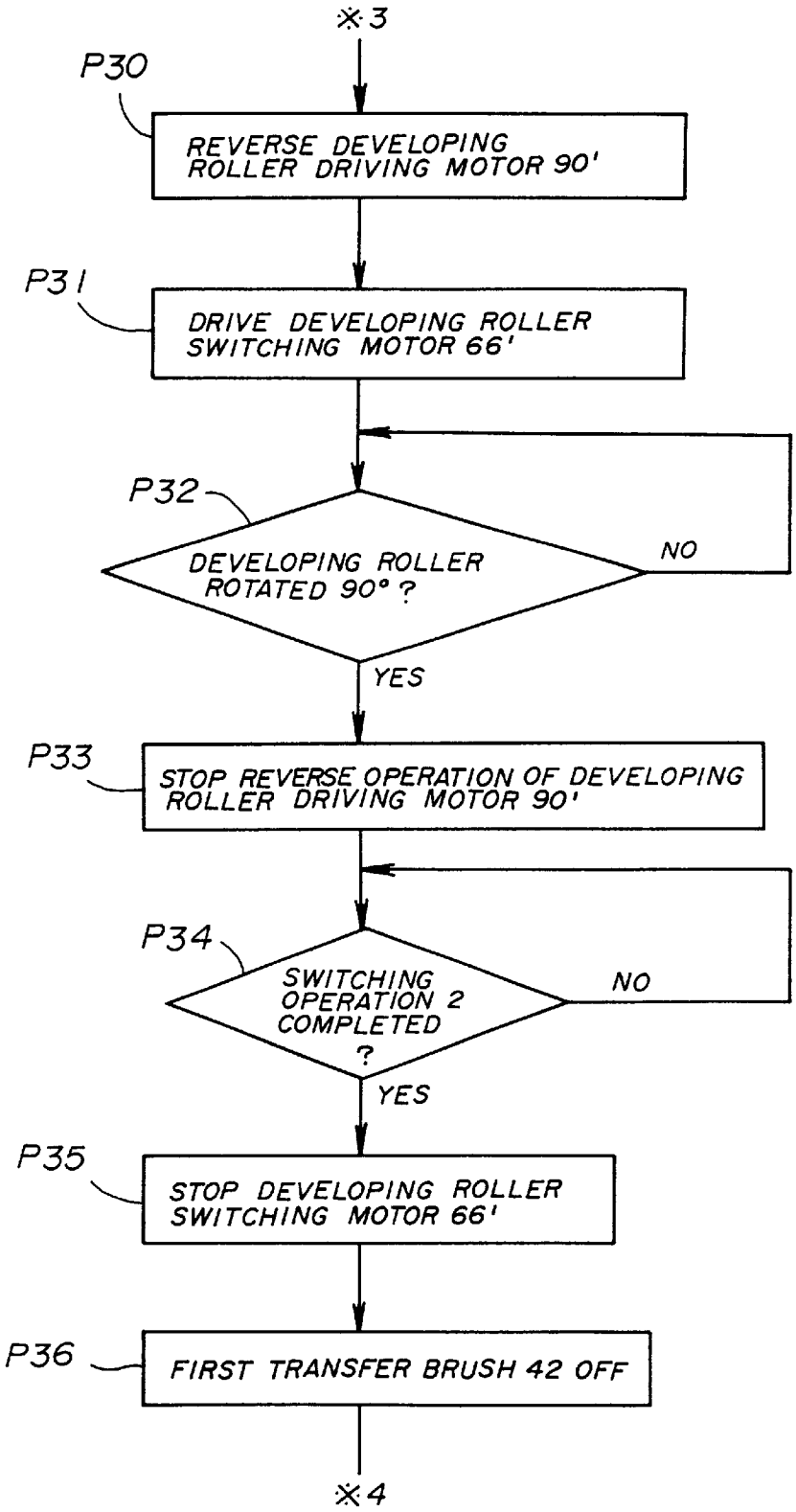
FIG. 25 is a part of the flowchart shown in FIG. 21.
Figure 26:
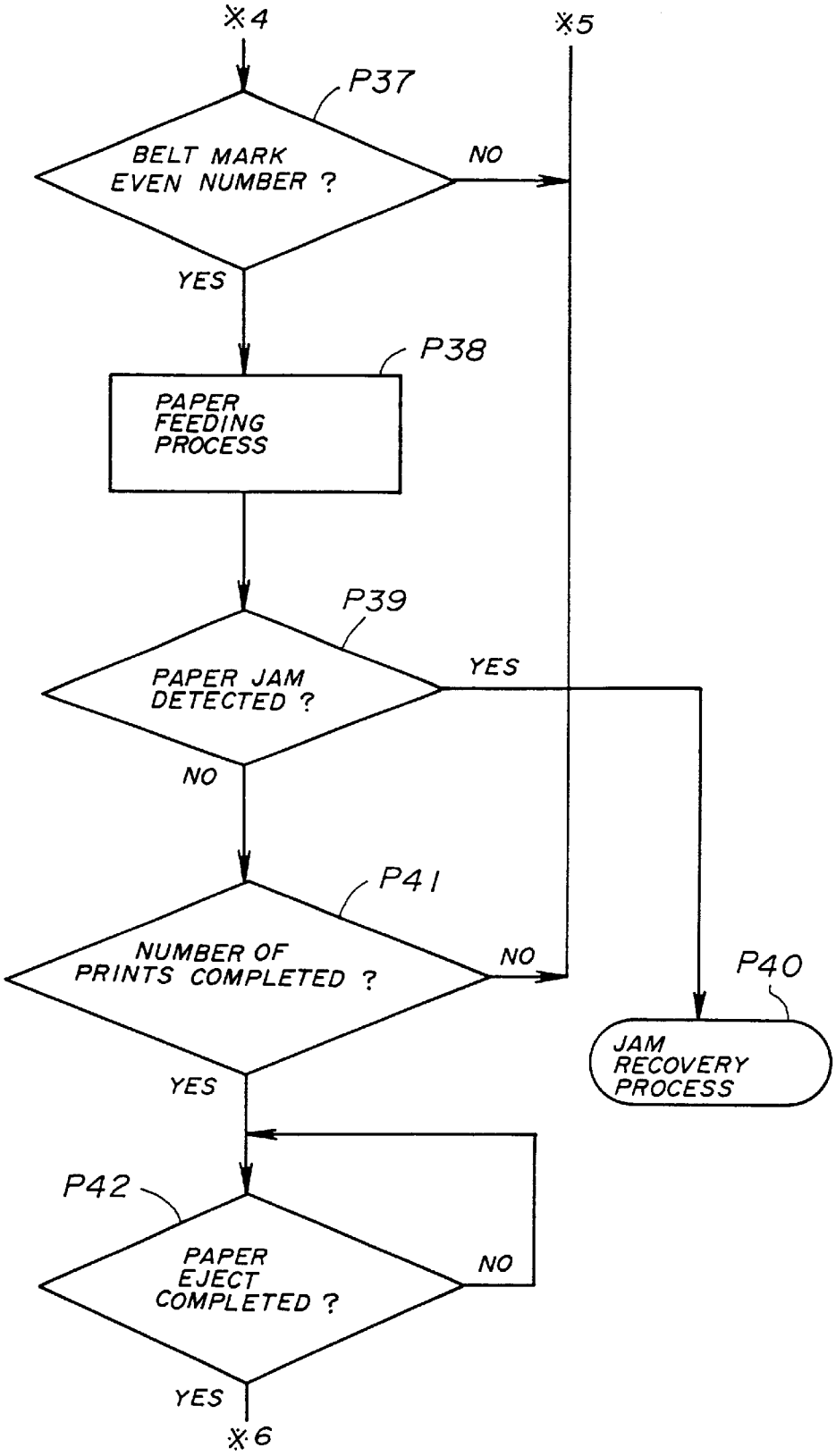
FIG. 26 is a part of the flowchart shown in FIG. 21.
Figure 27:
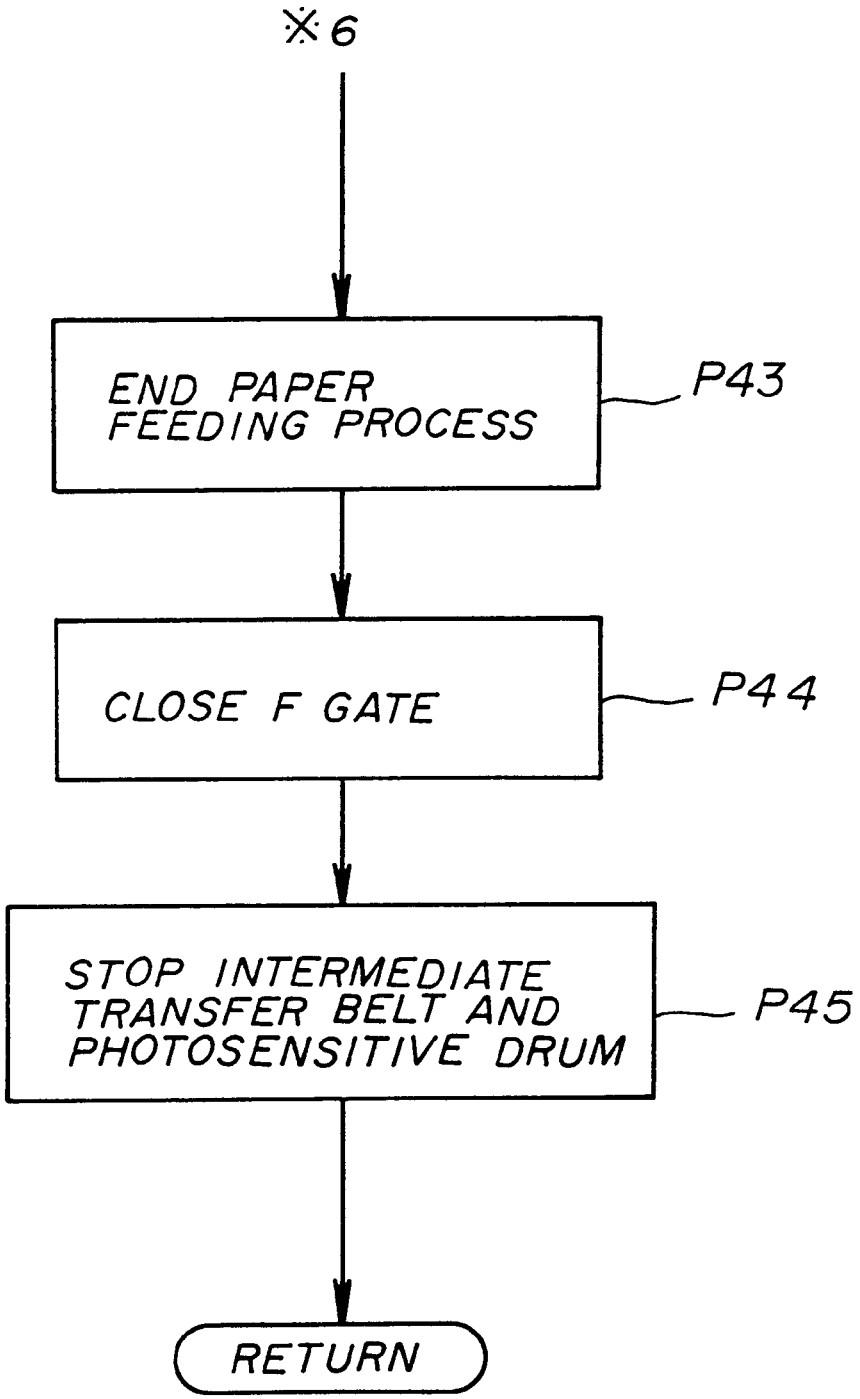
FIG. 27 is a part of the flowchart shown in FIG. 21.

FIG. 20 is a timing chart for explaining a process performed after the print switch is turned on and until a toner image is transferred onto the intermediate transfer belt. FIGS. 21 is a flowchart of the process performed after the print switch is turned on and until the intermediate transfer belt and the photosensitive drums are turned off. FIGS. 22 to 27 are parts of the flowchart shown in FIG. 21. Specifically, FIG. 22 corresponds to the part (a) of FIG. 21; FIG. 23 corresponds to the part (b) of FIG. 21; FIG. 24 corresponds to the part (c) of FIG. 21; FIG. 25 corresponds to the part (d) of FIG. 21; FIG. 26 corresponds to the part (e) of FIG. 21; FIG. 27 corresponds to the part (f) of FIG. 21. The entire flowchart shown in FIG. 21 is completed by connecting the same references ⊠1–⊠6 provided in each figure.

The image forming apparatus is turned on by turning on a main switch of the image forming apparatus. Then, it is determined, in step P1, whether or not the image forming apparatus is in a normal condition. If there is an abnormality such as a paper jam occurring in a path of the transfer paper P, the routine proceeds to step P2 to perform an abnormality process. In step P2, the paper jam is displayed on an operational panel of the image forming apparatus. Accordingly, an operator may open a cover of the image forming apparatus, and remove a jamming paper to eliminate a cause of the abnormality. If there is no abnormality, the routine proceeds to step P3 so as to wait for a print start instruction.

As shown in FIG. 20, the print ON signal S2 is raised by turning on the print switch. Then, the routine proceeds from step P3 to step P4. In step P4, a transfer cleaning signal is turned on. When the transfer cleaning signal is turned on, a cleaning blade of the cleaning device 61 (refer to FIG. 4) is made to contact an outer surface of the intermediate transfer belt 10 so as to perform a cleaning operation. Then, in step P5, operations of the photosensitive drums 16 and 26 and the intermediate transfer belt 10 are started. In step P6, the developing roller driving motors 90 and 90' are rotated in the normal direction. This is indicated by a rising in a waveform of each of the developing roller driving motors 90 and 90' indicated in FIG. 20, the rising being in synchronization with the print ON signal S2. When the developing roller driving motor 90 rotates in the normal direction, the developing roller 32 is rotated in the normal direction. Similarly, when the developing roller driving motor 90' rotates in the normal direction, the developing roller 34 is rotated in the normal direction. This is indicated by the reference numerals 32 and 34 provided in rows of the developing rollers in FIG. 20.

Since the intermediate transfer belt 10 is rotated, the belt mark on the intermediate transfer belt 10 is detected, in step P7, by the belt mark sensor 102, and a pulse signal is output from the belt mark sensor 102 as shown in FIG. 20. Thereafter, the pulse signal is output each time the belt mark is detected. When the output of the belt mark sensor 102 is input to the control means 100, an F gate signal is generated.

Thus, it is determined in step P8, whether the F gate signal has been generated. If it is determined that the F gate signal has not been generated, the routine proceed to step P9 so as to generate the F gate signal. The F gate signal is generated by the CPU provided in the control means 100, and serves as an enable signal for various control signals.

Then, it is determined, in step P10, whether or not the number of detections of the belt mark on the intermediate transfer belt 10 is an even number. If the number of detections is an odd number (not an even number), a cleaning operation for the intermediate transfer belt 10 is performed, in step P11, by the cleaning device 61. On the other hand, if the number of detections is an even number, the cleaning operation is canceled in step P13. As mentioned above, the cleaning operation is performed (on) or not performed (off) by referring to the number of detections of the belt mark. This is because the image to be transferred to the first sheet is still in a process when the intermediate transfer belt 10 is in an odd number rotation (first rotation), and the image transfer to the intermediate transfer belt 10 is completed when the intermediate transfer belt 10 has performed an even number rotation (second rotation).

Then, in step P12, it is determined whether or not a writing operation of a latent image to the photosensitive drum 16 by the writing means 18 is started. The writing operation is started when a period t1 has passed after the pulse signal of the belt mark sensor is input. Thereafter, a writing operation by the writing means 18 is performed when the period t1 has passed after each time the pulse signal is output from the belt mark sensor 102.

It is determined, in step P14, whether or not the detection of the belt mark at this time is the first time detection. Since the detection of the belt mark is the first detection at this time, the routine proceeds to step P16. The latent image written by the writing means 18 is developed by the developing roller 32 in an A color toner image, and the developed A color toner image rotates with the photosensitive drum 16 to the transfer position at which the first transfer brush 41 is provided. When a period t2 has passed after the start of the writing operation by the writing means 18, the first transfer brush 41 is put in contact with the intermediate transfer belt 10 in step P16. Accordingly, the toner image on the photosensitive drum 16 can be transferred onto the intermediate transfer belt 10. This operation is performed by the first transfer moving mechanism 106.

In step P17, a writing operation of a latent image to the photosensitive drum 26 by the writing means 28 is started when a period t3 has passed after the start of the writing operation to the photosensitive drum 16. The period t3 is determined so as to achieve a timing at which the developed images on the photosensitive drums 16 and 26 are superimposed onto the intermediate transfer belt 10.

It is determined, in step P18, whether or not the detection of the belt mark at this time is the first time detection. Since the detection is the first time detection at this time, the routine proceeds to step P20. The latent image written by the writing means 28 is developed by the developing roller 34 in a B color toner image, and is moved to the transfer position in which the second transfer brush 42 is provided. In step P20, the second transfer brush 42 is put in contact with the intermediate transfer belt 10 when a period t4 has passed after the start of the writing operation by the writing means 28. This operation is performed by the second transfer brush moving mechanism 108. It should be noted that a period t8 from the first transfer brush 41 is turned on until the second transfer brush 42 is turned on corresponds to a period required for the intermediate transfer belt 10 to move from the first transfer brush 41 to the second transfer brush 42. Accordingly, a toner image formed by the first image station 14 and a toner image formed by the second image station 24 can be transferred onto the intermediate transfer belt 10 so as to be superimposed thereon.

In this example, when an entire image forming operation by both the first image station 14 and the second image station 24 is considered, the developing rollers 32 and 33 in the first developing device 6 and the developing rollers 34 and 35 in the second developing device 8 are operated in an order of "developing roller 32→developing roller 34→developing roller 33→developing roller 35"→"developing roller 32→developing roller 34→developing roller 33→developing roller 35"→. . . . The operation in this order is performed for each sheet to be printed.

Accordingly, in the first image station 14, a switching of the developing roller to be used is performed in the order of "developing roller 32→developing roller 33"→"developing roller 32→developing roller 33"→. . . . Similarly, in the second image station 24, a switching of the developing roller to be used is performed in the order of "developing roller 34→developing roller 35"→"developing roller 34→developing roller 35"→. . . .

In the first image station 14, the switching of the developing rollers is performed by operating the driving-side power transmission mechanism 62 and the switching mechanism 68. A time for starting a reverse rotation of the developing roller 32 for a bristle cutting operation when switching from the developing roller 32 to the developing roller 33 corresponds to a time when a period t5 has passed after the writing operation by the writing means 18 was completed as shown in FIG. 20. The period t5 is set as a time when a trailing edge of the latent image on the photosensitive drum 16 passes the developing roller 32.

It is then determined, in step P21, whether or not the writing operation by the writing means 18 has been completed. After the writing operation by the writing means 18 is completed, the developing roller driving motor 90 is reversed in step P22. Then, in step P23, the developing roller switching motor 66 is operated during the reverse operation of the motor 90. The reverse operation of the developing roller driving motor 90 is continued. It is then determined, in step P24, whether or not the developing roller 32 is reversed 90 degrees. After the developing roller 32 is reversed 90 degrees for a bristle cutting operation, the reverse operation of the developing roller driving motor 90 is stopped in step P25. Then, it is determined, in step P26, whether or not the switching operation 1 in the first image station 14 is completed.

If it is determined, in step P26, that the switching operation 1 has been completed, the operation of the developing roller switching motor 66 is stopped in step P27. The determination of completion of the switching operation 1 is performed by counting a number of turns of the developing roller switching motor 66. Alternatively, a sensor may be provided to the rotational member so as to perform the determination by an output of the sensor.

The first transfer brush 41, which has been transferring the A color toner image formed by the developing roller 33 onto the intermediate transfer belt 10, is separated from the intermediate transfer belt 10 in step P28 when the A color toner image has passed the first transfer brush 41. It is then determined, in step P29, whether or not the writing operation by the writing means 28 is completed. The writing operation to the photosensitive drum 26 by the writing means 28 is completed when a period t6 has passed after the separation of the intermediate transfer belt 10.

If it is determined, in step P29, that the writing operation is completed and when a period t7 (corresponding to the period t5) has passed after the writing operation by the writing means 28 was completed, the developing roller driving motor 90' is reversed so as to perform a bristle cutting operation for the developing roller 34. Similar to the above-mentioned process of steps P23 to P28, a switching operation from the developing roller 34 to the developing roller 35 is performed in the process of steps P30 to P36.

That is, a connection of the developing unit drive system is switched from the developing roller 34 to the developing roller 35 while a bristle cutting operation is performed for the developing roller 34, and the second transfer brush 42, which has been turned on in step P20 after the transfer of the B color toner image by the developing roller 34, is separated from the intermediate transfer belt 10.

Then, it is determined, in step P37, whether or not the number of detections of the belt mark on the intermediate transfer belt 10 is an even number. Since the number is still "1" at this time, the routine returns to step P7 so as to wait for a detection of the belt mark. When the belt mark is detected, the routine proceeds to step P10 via the step P8. Since the number of detections is an even number, the routine proceeds to step P13. In step P13, a cleaning operation of the cleaning device 61 is canceled (off) so that the A color and B color toner images on the intermediate transfer belt 10 are not removed.

Thereafter, in step P12, another latent image is written on the photosensitive drum 16 by the writing means 18, and the routine proceeds to step P14. Since the detection of the belt mark is the second detection, the routine proceeds to step P15. In step P15, the developing roller driving motor 90 which had been stopped after the reverse is rotated in the normal direction so as to develop the latent image formed in step P12 by the developing roller 33 in C color.

Thereafter, in step P16, a transfer operation of a C color toner image onto the intermediate transfer belt 10 is started. Then, in step P17, a latent image is written on the photosensitive drum 26 by the writing means 28 in the image station 24, and the routine proceeds to step P19 via the step P18. In step P19, the developing roller drive motor 90' is operated so as to develop the latent image by the developing roller 35 in the D color. In step P20, the D color toner image is transferred onto the intermediate transfer belt 10 by operating the second transfer brush 42. Accordingly, the D color toner image is transferred onto the A color, B color and C color toner images on the intermediate transfer belt 10 so as to be superimposed thereon.

After the transfer operation is completed in step P20, a bristle cutting operation for the developing roller 33 is performed, in step P22, by reversing the developing roller driving motor 90 so as to switch the developing roller to be used from the developing roller 33 to the developing roller 32. During this reverse operation, the rotational member 64 is rotated, in step P22, by operating the developing roller switching motor 66.

After the developing roller 33 is rotated 90 degrees for a bristle cutting operation in step P24, the reverse rotation of the developing roller driving motor 90 is stopped in step P25, and the developing roller switching motor 66 is stopped, in step P27, after the completion of the switching from the developing roller 33 to the developing roller 32 is confirmed. When the C color toner image has passed the first transfer brush 41, the first transfer brush 41 is separated from the intermediate transfer belt 10 in step P28.

Similarly, in the second image station 24, switching of the developing roller to be used is performed from the developing roller 35 to the developing roller 34 in the same manner as the steps P29 to P36. Additionally, the transfer of the D color toner image onto the intermediate transfer belt 10 is performed. The transfer of the four toner images is completed when the second transfer brush 42 is separated from the intermediate transfer belt 10 in step P36. Thereafter, a third detection of the belt mark is performed by the belt mark sensor 102. Accordingly, the printing operation for the first sheet is completed in a period after the first signal is output from the belt mark sensor 102 and immediately before the third signal is output from the belt mark sensor 102. Subsequent sheets are printed in the same sequence as indicated by a "first sheet' and a 'second sheet" in FIG. 20.

The superimposed four-color toner image on the intermediate transfer belt 10 is transferred onto the transfer paper P in the process of step P37 and the subsequent steps. In step P37, it is determined whether or not the number of times of the detection of the belt mark by the belt mark sensor 102 at this time is an even number. Since the number of times is "2" at this time, the routine proceeds to step P38 so as to perform a paper feeding process.

In the paper feeding process, the transfer paper P is fed from the paper supply unit (not shown in the figure), and the transfer paper P reaches the register rollers 44. The register rollers 44 deliver the transfer paper P at an appropriate timing so that the superimposed four-color toner image on the intermediate transfer belt 10 meets the transfer paper P at the position of the transfer roller 11. The transfer paper P onto which the toner image is transferred by the transfer roller 11 is subjected to a fixing operation while the transfer paper P passes through the fixing device 50. Then, the transfer paper P is conveyed toward the eject tray 53 via the eject rollers 54.

It is determined, in step P39, whether or not a paper jam is detected in the process of conveyance of the transfer paper P. If a paper jam is detected, a jam recovery process is performed in step P40. If there is no paper jam, it is then determined, in step P41, whether or not the image forming process for the designated number of sheets has been completed. If it has not been completed, the routine returns to step P7 so as to perform the rest of the image forming process. If the image forming process has been completed, it is then determined, in step P42, whether or not the last sheet has been ejected to the eject tray 53. If the ejection of the last sheet is completed, the paper feeding process is ended in step P43. Then, in step P44, the F gate is closed. Thereafter, in step P45, operations of the intermediate transfer belt 10 and the photosensitive drums 16 and 26 are stopped.

In the above-mentioned image forming process, the sequential operations for switching the driving-side power transmission mechanism 62 by the switching mechanism 68 which is performed during a reverse operation of the driving-side power transmission mechanism 62 for bristle cutting in the first developing device in the first image station 14 is achieved by an operation of the developing roller switching motor 66. As can be appreciated from the time chart of FIG. 20, the timing for operating the motor 66 is determined so that the operation of the motor 66 is started after the completion of development by the developing roller being used before switching and the switching is completed before a latent image to be developed by the developing roller used after switching reaches a position of development by the developing roller used after the switching. In the above-mentioned image forming apparatus, the switching operation is completed before a latent image to be developed by the developing roller used after switching is formed, that is, before a latent image is formed by the writing means 18.

This also applies to the second developing device 8 in the second image station 24. That is, the sequential operations for switching engagement of the driving-side power transmission mechanism 62 are performed before a writing operation by the writing means 28 is started. Thereby, the development of a latent image by the developing roller used after switching can be performed.

Additionally, even if an arbitrary number of sheets are printed, the developing rollers have been returned to an initial state in which a new print operation is started. Thus, the sequential operations of the image forming process can be started without switching the developing rollers. Further, since there is no need to change an output order of sets of image data stored in an image memory for the writing means 18 and 28, the control means for output image data is prevented from being complicated.

In the above-mentioned image forming apparatus, the second image station 24 is located on the downstream side of the first image station 14 in the direction of rotation of the intermediate transfer belt 10. Accordingly, the second developing device 8 is located on the downstream side of the first developing device 6 in the direction of rotation of the intermediate transfer belt 10. Additionally, the transfer unit 11 is located on the downstream side of the second developing device 8 so that a superimposed toner image transferred to the intermediate transfer belt 10 is transferred onto the transfer paper P.

According to this structure, the superimposed toner image on the intermediate transfer belt 10 can be efficiently transferred onto the transfer paper P by transferring a toner image formed by the second image station 24 located on the downstream side onto a toner image which was formed by the first image station 14 located on the upstream side and was transferred onto the intermediate transfer belt 10 rather than transferring a toner image formed by the first image station 14 located on the upstream side onto a toner image which was formed by the second image station 24 located on the downstream side and was transferred onto the intermediate transfer belt 10.

Accordingly, in the above-mentioned image forming apparatus, development by the first developing device 6 is performed prior to the development by the second developing device 8. Specifically, development is performed in the order of "developing roller 32→developing roller 34→developing roller 33→developing roller 35"→"developing roller 32→developing roller 34→developing roller 33→developing roller 35"→"developing roller 32→developing roller 34→developing roller 33→developing roller 35"→. . . .

In this case, one of the developing rollers 32 and 33 operated first in the first developing device 6 and one of the developing rollers 34 and 35 operated first in the second developing device 8 can be arbitrarily determined.

For example, there is a method in which the developing roller used at the end of the order of use in the immediately preceding printing cycle is used at the beginning of an order of use in the present printing cycle. Specifically, the use of the developing rollers is in the order of "developing roller 32→developing roller 34→developing roller 33→developing roller 35"→"developing roller 33→developing roller 35→developing roller 32→developing roller 34"→"developing roller 32→developing roller 34→developing roller 33→developing roller 35"→"developing roller 33→developing roller 35→developing roller 32→developing roller 34"→. . . .

That is, with respect to the first developing device 6, development is performed in the order of "developing roller 32→developing roller 33"→"developing roller 33→developing roller 32"→"developing roller 32→developing roller 33"→"developing roller 33→developing roller 32"→. . . . With respect to the second developing device 8, development is performed in the order of "developing roller 34→developing roller 35"→"developing roller 35→developing roller 34"→"developing roller 34→developing roller 35"→"developing roller 35→developing roller 34"→. . . .

In the above-mentioned order, a pair of developing rollers parenthesized by (" ") corresponds to a formation of a single sheet. Accordingly, there is no need to switch the developing rollers each time a single sheet of print paper P is printed. Accordingly, if this development order is used, frequency of switching the developing rollers is reduced. This results in an increase in a processing speed of an image forming operation. Additionally, service life of the driving-side power transmission mechanism can be extended.

As mentioned above, when the developing roller used at the end of the immediately preceding image forming cycle is used at the beginning of the subsequent image forming cycle, there is no need to switch the developing rollers at an interval of each sheet when a plurality of sheets are continuously printed. Thus, there is room for switching time and a length of the intermediate transfer belt.

When a user make a color copy, a full-color copy which requires the above-mentioned image forming operation may be desired. However, there is a case in which the user desires to take a copy in one of the four colors, that is, cyan, magenta, yellow and black. In order to satisfy such a desire of users, a single-color mode may be provided to an image forming apparatus in addition to a full color mode. In the single-color mode, a user can select one of the four colors, that is, cyan, magenta, yellow and black.

In the image forming apparatus in which the full color mode and the single-color mode can be selected, it is desired to rapidly output a color copy in a selected color or colors with an easy control. Accordingly, in the image forming apparatus according to the present invention, one of the developing rollers which develops an image in a most frequently used color in the single color mode is put in the first position in the order of use of the developing rollers in the full-color mode.

For example, if magenta is the most frequently used color for the single color mode, the developing roller 32 which develops an image in an M color developer is set to be the developing roller used in the first position in the order of use in the full-color mode. In such a method of use, the developing roller 32 which develops the M color image is initially used when power is turned on in either the single-color mode or the full-color mode.

If C color is the most frequently used color in the single color mode, the initially used developing roller must be changed from the developing roller 32 which develops an M color image to the developing roller 33 which develops a C color image, which requires a time for changing. In this respect, in the image forming apparatus using the above-mentioned method, the developing roller is not required to be changed when the single-color mode is selected since the firstly used developing roller in the full-color mode is the same as the developing roller which is most frequently used in the single color mode. Thus, an image forming process can be immediately started most of the time when the single color mode is selected.

Generally, the most frequently used color is black. Accordingly, the single-color mode can be rapidly performed by setting the initially used developing roller in the full-color mode to the developing roller which uses a black color developer.

Specifically, when an image forming operation is performed in the full-color mode by setting the order of use of the developing rollers as "developing roller 32→developing roller 34→developing roller 33→developing roller 35"→"developing roller 32→developing roller 34→developing roller 33→developing roller 35"→"developing roller 32→developing roller 34→developing roller 33→developing roller 35"→. . . or "developing roller 32→developing roller 34→developing roller 33→developing roller 35"→"developing roller 33→developing roller 35→developing roller 32→developing roller 34"→"developing roller 32→developing roller 34→developing roller 33→developing roller 35"→. . . . the developer used by the A color developing unit 19 provided with the developing roller 32 is set to be a combination of a black toner and a carrier and the developer used by the D color developing unit 30 is set to be a combination of a magenta toner and a carrier. The developer provided to the C color developing unit 29 is a combination of a cyan toner and a carrier as explained before, and the developer provided to the Y color developing unit 20 is a combination of a yellow toner and a carrier as explained before.

As mentioned above, in the image forming apparatus according to the present invention in which the developing roller initially used after power is turned on is set to be the developing roller for a black toner image, a frequency of switching of the developing rollers is decreased.

As shown in FIG. 4, in the first image station 14, the developing roller 32 is located on the downstream side of the writing position in which the writing means 18 is located in a direction of rotation of the photosensitive drum 16. Additionally, the development roller 33 is located on the downstream side of the developing roller 32. In this arrangement of the developing rollers 32 and 33, a distance between the writing means 18 and the developing roller 33 is greater than a distance between the writing means 18 and the developing roller 32. Accordingly, a time need for a latent image formed by the writing means 18 to reach the developing roller 33 is longer than a time needed for a latent image formed by the writing means 18 to reach the developing roller 32.

Accordingly, if a development is performed by the developing roller 32 first and then a development is performed by the developing roller 33, a switching operation for the developing rollers can be performed with a margin that is more than that of a case in which a development is performed first by the developing roller 33 and then a development is performed by the developing roller 32. Thus, in the image forming apparatus according to the present invention, a development may be performed by the developing roller 32. This can also be applied to the second image station 24, and a development may be performed first by the developing roller 35 and then performed by the developing roller 34.

Figure 28:
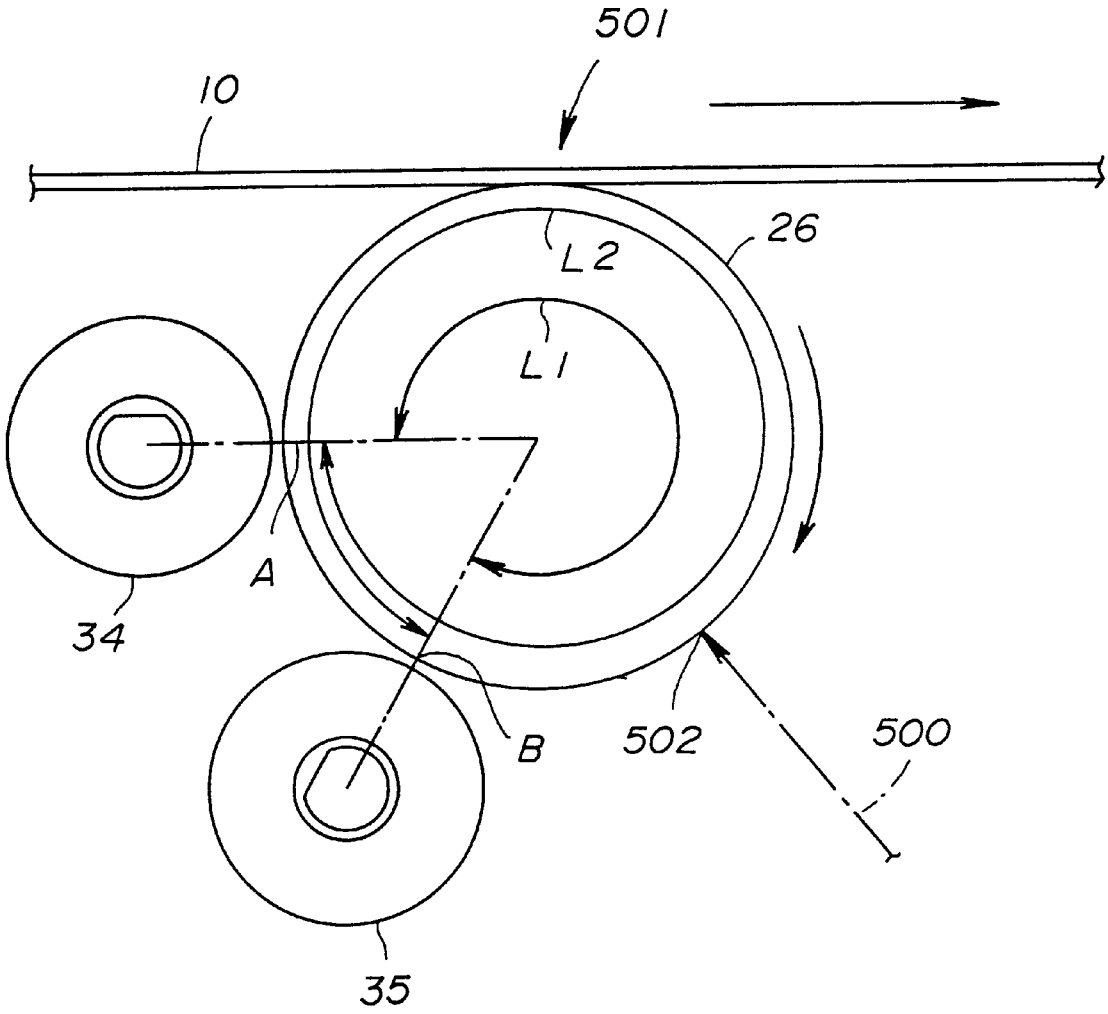
FIG. 28 is an illustration of a part of the image forming apparatus shown in FIG. 4 including a photosensitive drum and developing rollers.

FIG. 28 shows a part of an image forming apparatus including the photosensitive drum 26 and the developing rollers 34 and 35. In FIG. 28, the photosensitive drum 26 as an image carrying member rotates in a direction indicated by an arrow in the figure when an image is formed on the photosensitive drum 26. The intermediate transfer belt 10 contacts an upper portion of the photosensitive drum 26. In the upper portion, an image formed on the photosensitive drum 26 is transferred to the intermediate transfer belt 10. This portion is referred to as an intermediate transfer position. The intermediate transfer belt 10 is formed as a seamless belt.

The intermediate transfer belt 10 moves in a direction indicated by an arrow in the figure. A linear velocity of the photosensitive drum 26 is equal to a linear velocity of the intermediate transfer belt 10 in the intermediate transfer position 501.

A beam is projected from the writing means 28 (not shown in the figure) to a light writing position 502 on a circumferential surface of the photosensitive drum 26, as indicated by an arrow 500. When an image is formed, a light is projected from the writing means to the photosensitive drum 26 at the light writing position 502 while the photosensitive drum 26 is rotated so as to form a latent image on the photosensitive drum 26.

The developing rollers 34 and 35 are provided adjacent to the photosensitive drum 26 between the light writing position 502 and the intermediate transfer position 501 in a rotational direction of the photosensitive drum 26. Each of the developing rollers 34 and 35 develops the latent image on the photosensitive drum 26 by different color developing agents. It should be noted that although the charging means, the writing means and the cleaning means are provided around the photosensitive drum 26, these means are not shown in the figure so as to avoid the figure from being complicated.

When a two-color image is formed, a single-color visible image formed by one of the developing rollers 34 and 35 is transferred to the intermediate transfer belt 10, and then a different color image formed by the other one of the developing rollers 34 and 35 is superimposed. Then, the superimposed image is transferred onto a transfer paper. The image on the transfer paper P is fixed by the fixing device, and the transfer paper is ejected.

A description will now be given of a detail of the above-mentioned image forming operation. First, a latent image is formed on the photosensitive drum 26 by the beam 500 for a first color image. The latent image is developed as a first visible image by the developing roller 34. The first visible image is transferred onto the intermediate transfer belt 10 at the position 501. Then, another latent image is formed on the photosensitive drum 26 by another beam 500 for a different color image. This latent image is formed on the photosensitive drum 26 while the visible image on the intermediate transfer belt 10 makes a full turn and returns to the intermediate transfer position 501. The latent image is developed as a second visible image by the developing roller 35. The second visible image is superimposingly transferred onto the first visible image which reached the intermediate transfer position 501 by rotating with the intermediate transfer belt 10.

In the above-mentioned image forming process, the developing operations by the developing roller 34 and the developing roller 35 are selectively performed in synchronization with movement of the latent images on the photosensitive drum 26. The switching operation for the developing rollers 34 and 35 should be performed within a period from a time when the trailing edge of the first visible image passes the developing roller 34 until the leading edge of the latent image to be developed as the second visible image reaches the developing roller 35. Hereinafter, the period required for switching the developing rollers is referred to as a time Ta.

On the other hand, the switching operation for the developing rollers requires a period for operating a mechanism for moving the developing rollers and a time for actually moving the developing rollers. The period required for switching the developing rollers is referred to as a time Th.

According to the above-mentioned definition, if a fixed means is used for the switching means, the time Th is constant. Additionally, if a speed for forming an image is increased so as to reduce a time for forming the image, a rotational speed of the photosensitive drum 26 is increased. Thus, the time Ta is decreased. In such a case, any image forming speed can be used as long as a condition Ta>th is satisfied.

Accordingly, if a developing operation that can increase the time Ta is performed, a rotational speed of the photosensitive drum 26 can be increased. Thus, the speed for forming the image can be increased.

In FIG. 28, a comparison is made between a case (a) in which a latent image is developed by the developing roller 34 located on the downstream side of the developing roller 35 and a subsequent latent image is developed by switching the developing roller 34 to the developing roller 35 and a case (b) in which a latent image is developed by the developing roller 35 located on the upstream side of the developing roller 34 and a subsequent latent image is developed by switching the developing roller 35 to the developing roller 34.

For example, if there is provided a non-image area between a preceding latent image and a present latent image on the photosensitive drum 26, a length of the non-image area corresponds to a distance from the trailing edge of the preceding image (the leading edge of the non-image area) to a leading edge of the subsequent image (the trailing edge of the non-image area) along the circumference of the photosensitive drum 26.

It is assumed that one of the developing rollers 34 and 35 which firstly performs a development is referred to as a preceding developing roller and the other one of the developing rollers 34 and 35 which secondly performs a development is referred to as a subsequent developing roller. A period from a time when the trailing edge of the preceding image (the leading edge of the non-image area) passes the preceding developing roller to a time when the leading edge of the subsequent image (the trailing edge of the non-image area) passes the subsequent developing roller corresponds to a period allowed for switching the preceding developing roller to the subsequent developing roller.

In the case (a) in which a latent image is developed by the developing roller 34 located on the downstream side of the developing roller 35 in the direction of rotation of the photosensitive drum 26 and a subsequent latent image is developed by switching the developing roller 34 to the developing roller 35, the developing roller 34 on the downstream side corresponds to the preceding developing roller and the developing roller 35 on the upstream side corresponds to the subsequent roller. On the assumption that the trailing edge of the preceding image (the leading edge of the non-image area) is a point A indicated in FIG. 28, the leading edge of the subsequent image (the trailing edge of the non-image area) is coincident on the point A after a complete single turn of the photosensitive drum 26 since the length of the non-image area is equal to the length of the circumference of the photosensitive drum 26. The leading edge of the subsequent image (the trailing edge of the non-image area) is referred to as a point A' since the point A' is coincident with the point A with respect to a position on the photosensitive drum 26.

Accordingly, a period needed for the photosensitive roller 26 to rotate from a position where the trailing edge of the preceding image (the leading edge of the non-image area= the point A) passes the position of the preceding developing roller (developing roller 34) to a position where the leading edge of the subsequent image (the trailing edge of the non-image area=the point A') passes the position of the subsequent developing roller (the developing roller 35) corresponds to a period during which the point A on the photosensitive drum 26 rotates a distance L1 in a direction indicated by an arrow so that the point A reaches the position of the developing roller 34. This period corresponds to a period Ta which is allowed for switching the developing rollers.

In the case (b) in which a latent image is developed by the developing roller 35 located on the upstream side of the developing roller 34 in the rotational direction of the photosensitive roller 26 and a subsequent latent image is developed by switching the developing roller 35 to the developing roller 34, the developing roller 35 on the upstream side corresponds to the subsequent developing roller and the developing roller 34 on the downstream side corresponds to the subsequent roller. On the assumption that the trailing edge of the preceding image (the leading edge of the non-image area) is a point B indicated in FIG. 28, the leading edge of the subsequent image (the trailing edge of the non-image area) is coincident on the point B after a complete single turn of the photosensitive drum 26 since the length of the non-image area is equal to the length of the circumference of the photosensitive drum 26. The leading edge of the subsequent image (the trailing edge of the non-image area) is referred to as a point B' since the point B' is coincident with the point B with respect to a position on the photosensitive drum 26.

Accordingly, a period needed for the photosensitive roller 26 to rotate from a position where the trailing edge of the preceding image (the leading edge of the non-image area= the point B) passes the position of the preceding developing roller (developing roller 35) to a position where the leading edge of the subsequent image (the trailing edge of the non-image area=the point B') passes the position of the subsequent developing roller (the developing roller 34) corresponds to a period during which the point B on the photosensitive drum 26 rotates a distance L2 in the direction indicated by the arrow so that the point B reaches the position of the developing roller 34. This period corresponds to the period Ta which is allowed for switching the developing rollers.

Comparing the case (a) with the case (b), the distance L1 in the case (a) is equal to a distance obtained by subtracting a distance between the developing rollers 34 and 35 from the length of the circumference of the photosensitive drum 26, and is less than the length of the circumference of the photosensitive drum 26. On the other hand, the distance L2 in the case (b) is equal to a distance obtained by adding the distance between the developing rollers 34 and 35 to the length of the circumference of the photosensitive drum 26, and is greater than the length of the circumference of the photosensitive drum 26.

That is, it is apparent that the distance L2 is greater than the distance L1 (L2>L1). Accordingly, there is provided an extra time to the period Ta for switching the developing rollers for a period corresponding to a difference (L2−L1) between the distance L2 and the distance L1. Thus, it is possible to increase the image processing speed or provide an extra time to the period for switching the rollers. This is not limited to the case in which the length of the non-image area is set to be equal to the circumference of the photosensitive drum 26.

When the development is started from the developing roller 35 which is located on the upstream side, and then switched to the developing roller 34 on the downstream side, a processing speed of a monotone image can be increased by the developing roller 35 being provided with black toner which is frequently used.

In the image forming apparatus shown in FIG. 4, the image station 14 having a structure similar to the image station 24 shown in FIG. 28 which includes the photosensitive drum 26 and the developing rollers 34 and 35 is provided along the intermediate transfer belt 10 on the upstream side of the image station 24 in the moving direction of the intermediate transfer belt 10 so as to form a four-color image. If cyan, magenta, yellow and black are used as the four colors, a full-color image can be obtained.

Accordingly, if the developing roller 32 located on the upstream side in the rotational direction of the photosensitive drum 16 is used first and the developing roller 33 located on the downstream side is used second in the image station 14 as is similar to the method described with reference to FIG. 28, an extra period can be provided to the period for switching the developing rollers 32 and 33. Thus, a speed for forming an image can be increased as the entire image forming apparatus which results in an increase in a processing speed for a full color image.

The developed image formed on each of the photosensitive drums 16 and 26 in the first and second image stations 14 and 24 is transferred onto the intermediate transfer belt 10, and the developed image on the intermediate transfer belt 10 is transferred onto the transfer paper P by the transfer roller 11 which is located on the downstream side of the second image station 24 in the moving direction of the intermediate transfer belt 10. Thereafter, the toner image on the transfer paper P is fixed by the fixing device, and the transfer paper P is ejected.

In the image forming apparatus in which an image is formed in accordance with such a sequential developing operation, if the developing roller located on the upstream side in the image station closer to the transfer roller 11 is provided with black toner, that is, if the developing roller 35 located on the upstream side in the image station 24 which is closer to the transfer roller 11 is provided with black toner, the developing roller used first is rendered to use black developer. Additionally, since the developing roller 35 which is provided with black developer is closest to the position of the transfer roller 11, a desired monotone image can be obtained on the transfer paper in a shortest time.

It should be noted that a single component-type developer may be used for the developing device used in the image forming apparatus according to the present invention.

Additionally, although two developing rollers are provided in each of the image stations 14 and 24 in the above-mentioned image forming apparatus, more than two developing rollers may be provided in each of the image stations so that a number of the color component images formed by each image station is increased.

The present invention is not limited to the specifically disclosed embodiments, and variations and modifications may be made without departing from the scope of the present invention.

The present application is based on Japanese priority applications No.9-201599 filed on Jul. 28, 1997, No.9-270136 filed on Oct. 2, 1997 and No.9-292020 filed on Oct. 24, 1997, the entire contents of which are hereby incorporated by reference.

What is claimed is:

1. An image forming apparatus provided with a plurality of developing units including at least magenta (M), cyan (C), and black (K) colorant developing units, an intermediate transfer member, and a plurality of image stations arranged along a direction of movement of said intermediate transfer member, each of said image stations comprising:

an image carrying member;

at least two developing units, of said plurality of developing units, said M and C developing units being in a same image station in which said M unit is positioned lower than said C unit in a direction of gravity, said K developing unit being located in an image station different from said image station in which said M developing unit is located, and wherein latent images sequentially formed on said image carrying member are developed by one of said at least two developing units and developed images are transferred onto said intermediate transfer member so as to be superimposed thereon;

a developing unit driving system driving said at least two developing units; and a switching mechanism switching a transmission path of a power generated by said developing unit driving system so that the power is selectively transmitted to one of said at least two developing units, wherein said switching mechanism of each of said image stations includes:

a rotational member supporting a plurality of driving-side power transmission mechanisms each of which is a final stage of said developing unit driving system; and a rotational driving mechanism rotating said rotational member, and wherein each of said at least two developing units is connected to a driven-side power transmission mechanism selectively connectable to one of said driving-side power transmission mechanisms in accordance with a rotational position of said rotational member.

2. The image forming apparatus as claimed in claim 1, wherein said developing unit driving system, said rotational member and said rotational driving mechanism constituting said switching mechanism are incorporated into a single unit.

3. The image forming apparatus as claimed in claim 1, wherein said developing unit driving system includes a power transmission shaft used as a center of rotation of said rotational member.

4. The image forming apparatus as claimed in claim 1, wherein said rotational driving mechanism includes a worm gear and a motor for driving said worm gear, said worm gear being engaged with a sector gear provided to said rotational member so as to rotate said rotational member.

5. The image forming apparatus as claimed in claim 4, wherein said motor is a reversible motor.

6. The image forming apparatus as claimed in claim 2, wherein said rotational driving mechanism includes a cam engaged with a cam follower provided to said rotational member.

7. The image forming apparatus as claimed in claim 6, wherein said cam includes an annular groove, and said cam follower movably fits in said annular groove.

8. The image forming apparatus as claimed in claim 1, wherein said rotational driving mechanism includes a solenoid actuator for swinging said rotational member.

9. The image forming apparatus as claimed in claim 1, wherein each of said driving-side power transmission mechanisms comprises a first gear, and each of said driven-side power transmission mechanisms comprises a second gear.

10. A developing apparatus for developing a latent image formed on an image carrying member by a first developing roller and a second developing roller, said first developing roller developing a latent image in a first color and said second developing roller developing a latent image in a second color, a bristle cutting operation being performed by reversely rotating one of the first developing roller and the second developing roller when the one of the first developing roller and the second developing roller which has performed a developing operation is switched to the other, said developing apparatus comprising:

a first gear arrangement connected to said first developing roller;

a second gear arrangement connected to said second developing roller;

a drive gear mechanism engageable with said first gear arrangement and said second gear arrangement for transmitting a drive power so as to commonly drive said first developing roller and said second developing roller;

a rotational member moving said drive gear mechanism so that said second gear arrangement is disengaged from said drive gear mechanism when said first gear arrangement is engaged with said drive gear mechanism and said first gear arrangement is disengaged from said drive gear mechanism when said second gear arrangement is engaged with said drive gear mechanism; and control means for controlling timing of a switching operation for switching an engagement of said drive gear mechanism from one of said first gear arrangement and said second gear arrangement to the other so that said switching operation is performed during a reverse operation of said drive gear mechanism.

11. A method for controlling a developing apparatus for developing a latent image formed on an image carrying member by a first developing roller and a second developing roller, said first developing roller developing a latent image in a first color and said second developing roller developing a latent image in a second color, a bristle cutting operation being performed by reversely rotating one of the first developing roller and the second developing roller when the one of the first developing roller and the second developing roller which has performed a developing operation is switched to the other, said developing apparatus comprising:

a first gear arrangement connected to said first developing roller;

a second gear arrangement connected to said second developing roller;

a drive gear mechanism engageable with said first gear arrangement and said second gear arrangement for transmitting a drive power so as to commonly drive said first developing roller and said second developing roller; and a rotational member moving said drive gear mechanism so that said second gear arrangement is disengaged from said drive gear mechanism when said first gear arrangement is engaged with said drive gear mechanism and said first gear arrangement is disengaged from said drive gear mechanism when said second gear arrangement is engaged with said drive gear mechanism, the method for controlling said developing apparatus comprising the steps of:

reversely operating said drive gear mechanism so as to perform the bristle cutting operation; and switching an engagement of said drive gear mechanism from one of said first gear arrangement and said second gear arrangement to the other while said drive gear mechanism is reversely operated.

12. A method for controlling a plurality of developing apparatuses arranged along an intermediate transfer member, each of said developing apparatuses developing a latent image formed on an image carrying member by a first developing roller and a second developing roller, said first developing roller developing a latent image in a first color and said second developing roller developing a latent image in a second color, a bristle cutting operation being performed by reversely rotating one of the first developing roller and the second developing roller when the one of the first developing roller and the second developing roller which has performed a developing operation is switched to the other, each of said developing apparatuses comprising:

a first gear arrangement connected to said first developing roller;

a second gear arrangement connected to said second developing roller;

a drive gear mechanism engageable with said first gear arrangement and said second gear arrangement for transmitting a drive power so as to commonly drive said first developing roller and said second developing roller; and a rotational member moving said drive gear mechanism so that said second gear arrangement is disengaged from said drive gear mechanism when said first gear arrangement is engaged with said drive gear mechanism and said first gear arrangement is disengaged from said drive gear mechanism when said second gear arrangement is engaged with said drive gear mechanism, the method for controlling said developing apparatuses comprising the steps of:

operating said first and second developing rollers of each of said developing apparatuses in a predetermined order of use so as to sequentially develop the latent images;

transferring developed images from said image carrying member of each of said developing apparatuses to said intermediate transfer member; and controlling a switching operation for switching an engagement of said drive gear mechanism from one of said first gear arrangement and said second gear arrangement to the other in each of said developing apparatuses so that said switching operation is performed at a predetermined timing, said switching operation being performed during a reverse operation of said drive gear mechanism for performing the bristle cutting operation.

13. The method as claimed in claim 12, wherein said predetermined timing is defined as a time prior to a start of a development by the other of the first and second developing rollers.

14. The method as claimed in claim 12, wherein said plurality of developing apparatuses include a first developing apparatus and a second developing apparatus located on a downstream side of said first developing apparatus in a direction of movement of said intermediate transfer member, and an image on said intermediate transfer member is transferred onto a transfer paper at a position located on a downstream side of said second developing apparatus in the direction of movement of said intermediate transfer member, and said predetermined order is determined so that one of the first and second developing rollers in said first developing apparatus is operated first; one of the first and second developing rollers in said second developing apparatus is operated second; the other of the first and second developing rollers in said first developing apparatus is operated third; and the other of the first and second developing rollers in said second developing apparatus is operated fourth.

15. The method as claimed in claim 14, wherein said one of said first and second developing rollers in each of said first and second developing apparatuses is located on an upstream side of the other of said first and second developing rollers in a direction of rotation of said image carrying member.

16. The method as claimed in claim 12, wherein said plurality of developing apparatuses include a first developing apparatus and a second developing apparatus located on a downstream side of said first developing apparatus in a direction of movement of said intermediate transfer member, and said predetermined order is determined so that one of said first and second developing rollers used at the end of an immediately preceding image forming cycle is used at the beginning of a subsequent image forming cycle.

17. The method as claimed in claim 12, wherein one of said first developing roller and said second developing roller of one of said developing apparatuses which is set to be the first position in said predetermined order of use is provided with a developer of a color which is most frequently used.

18. The method as claimed in claim 12, wherein one of said first developing roller and said second developing roller of one of said developing apparatuses which is set to be the first position in said predetermined order of use is provided with a black developer.

* * * * *